US010462873B2

(12) United States Patent
Shuai et al.

(10) Patent No.: US 10,462,873 B2
(45) Date of Patent: Oct. 29, 2019

(54) BACKLIGHT CIRCUIT, ELECTRONIC DEVICE, AND BACKLIGHT ADJUSTMENT METHOD

(71) Applicant: HUAWEI TECHNOLOGIES CO., LTD., Shenzhen, Guangdong (CN)

(72) Inventors: Junqing Shuai, Beijing (CN); Haojing Zhang, Beijing (CN); Jianfei Chu, Beijing (CN); Shilei Wang, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/060,442

(22) PCT Filed: Dec. 9, 2015

(86) PCT No.: PCT/CN2015/096869
§ 371 (c)(1),
(2) Date: Jun. 8, 2018

(87) PCT Pub. No.: WO2017/096567
PCT Pub. Date: Jun. 15, 2017

(65) Prior Publication Data
US 2018/0368220 A1 Dec. 20, 2018

(51) Int. Cl.
*H05B 33/08* (2006.01)
*G09G 3/36* (2006.01)
*G09G 3/34* (2006.01)

(52) U.S. Cl.
CPC ..... *H05B 33/086* (2013.01); *G09G 3/3406* (2013.01); *G09G 3/36* (2013.01);
(Continued)

(58) Field of Classification Search
CPC .... H05B 33/0845; G09G 3/34; G09G 3/3406; G09G 3/36
See application file for complete search history.

(56) References Cited

U.S. PATENT DOCUMENTS 8,288,969 B2 10/2012 Hsu et al.
2003/0058235 A1* 3/2003 Moon ..... G09G 3/3696 345/212
(Continued)

FOREIGN PATENT DOCUMENTS

CN 201893106 U 7/2011
CN 102855849 A 1/2013
(Continued)

OTHER PUBLICATIONS

International Search Report and Written Opinion issued in International Application No. PCT/CN2015/096869 dated Aug. 26, 2016, 19 pages.
(Continued)

*Primary Examiner* — Jason Crawford
(74) *Attorney, Agent, or Firm* — Fish & Richardson P.C.

(57) ABSTRACT

A backlight circuit includes a backlight power supply chip and an adjustable resistor circuit. The backlight power supply chip includes a set pin configured to set a reference current, an input pin, and an output pin. One end of the adjustable resistor circuit is connected to the set pin. The adjustable resistor circuit further includes a control end, where the control end is configured to receive a switching signal. Based on the switching signal, the adjustable resistor circuit selects a resistor branch from a first resistor branch and a second resistor branch to connect to the set pin for generating the reference current. The backlight power supply chip is configured to generate a drive current based on the reference current and a duty cycle of a pulse-width modulation (PWM) signal received by the input pin, and output the drive current by using the output pin.

19 Claims, 10 Drawing Sheets

(52) U.S. Cl.
CPC ... *H05B 33/0845* (2013.01); *G09G 2320/064* (2013.01); *G09G 2320/0633* (2013.01)

(56) References Cited

U.S. PATENT DOCUMENTS

| | | | | |
|---|---|---|---|---|
| 2007/0001625 | A1 | 1/2007 | Kim et al. | |
| 2007/0262764 | A1* | 11/2007 | Warita | H02M 3/00 323/284 |
| 2007/0285378 | A1* | 12/2007 | Lankhorst | G09G 3/342 345/102 |
| 2012/0050343 | A1* | 3/2012 | Kim | G09G 3/3406 345/690 |
| 2012/0056864 | A1* | 3/2012 | Aioanei | G09G 3/3696 345/212 |
| 2012/0133636 | A1 | 5/2012 | Kita | |
| 2013/0235090 | A1* | 9/2013 | Choi | H05B 33/0827 345/690 |
| 2013/0313990 | A1* | 11/2013 | Zhou | H05B 37/02 315/201 |
| 2014/0015433 | A1 | 1/2014 | Kawata et al. | |
| 2015/0062188 | A1 | 3/2015 | Kang | |
| 2015/0170581 | A1 | 6/2015 | Zhang | |
| 2015/0206484 | A1 | 7/2015 | Gotoh | |
| 2015/0373796 | A1* | 12/2015 | Bahrehmand | H05B 33/0815 315/129 |
| 2016/0148560 | A1* | 5/2016 | Tsai | H01L 51/504 345/690 |
| 2016/0247471 | A1 | 8/2016 | Zhang et al. | |

FOREIGN PATENT DOCUMENTS

| | | | |
|---|---|---|---|
| CN | 103680444 | A | 3/2014 |
| CN | 103945590 | A | 7/2014 |
| CN | 104006324 | A | 8/2014 |
| CN | 203950537 | U | 11/2014 |
| CN | 104488020 | A | 4/2015 |
| CN | 104505034 | A | 4/2015 |
| EP | 2843650 | A1 | 3/2015 |
| EP | 2911144 | A1 | 8/2015 |
| GB | 2535100 | A | 8/2016 |
| JP | 2007294341 | A | 11/2007 |
| JP | 2012119069 | A | 6/2012 |
| JP | 2013102218 | A | 5/2013 |
| JP | 2015172723 | A | 10/2015 |
| KR | 20080017191 | A | 2/2008 |
| KR | 20150026468 | A | 3/2015 |

OTHER PUBLICATIONS

Extended European Search Report issued in European Application No. 15910042.9 dated Oct. 8, 2018, 9 pages.
Office Action issued in Chinese Application No. 201580071170.1 dated Mar. 20, 2019, 7 pages.
Office Action issued in Japanese Application No. 2018-529963 dated May 14, 2019, 9 pages (with English translation).
Office Action issued in Korean Application No. 10-2018-7019390 dated Jun. 23, 2019, 13 pages (with English translation).

* cited by examiner

| Summary table | First correspondence table | |
|---|---|---|
| Expected luminance value | Subtable luminance value | Duty cycle |
| 0 | 0 | 1% |
| ... | ... | ... |
| 50 | 100 | 20% |
| | 101 | 20.19% |
| 51 | 102 | 20.38% |
| | 103 | 20.57% |
| 52 | 104 | 20.66% |
| ... | ... | ... |
| 255 | 511 | 100% |
| Summary table | Second correspondence table | |
| Expected luminance value | Subtable luminance value | Duty cycle |
| 256 | 0 | 1% |
| | 1 | 1.19% |
| 257 | 2 | 1.38% |
| | 3 | 1.57% |
| 258 | 4 | 1.76% |
| | 5 | 1.95% |
| 259 | 6 | 2.14% |
| | 7 | 2.33% |
| 260 | 8 | 2.52% |
| ... | ... | ... |

BACKLIGHT CIRCUIT, ELECTRONIC DEVICE, AND BACKLIGHT ADJUSTMENT METHOD

CROSS-REFERENCE TO RELATED APPLICATIONS

This application is a national stage of International Application No. PCT/CN2015/096869, filed on Dec. 9, 2015, which is hereby incorporated by reference in its entirety.

TECHNICAL FIELD

Embodiments of the present invention relate to the field of liquid crystal display, and in particular, to a backlight circuit, an electronic device, and a backlight adjustment method.

BACKGROUND

Electronic devices such as a smartphone and a tablet computer use a liquid crystal display (English: Liquid Crystal Display, LCD for short) as a display component.

The LCD can perform normal display only by using a backlight provided by a backlight circuit. The backlight circuit is controlled by a backlight controller. The backlight circuit includes a backlight power supply chip and a backlight light emitting diode (English: Light Emitting Diode, LED for short) connected to the backlight power supply chip. In an operating process, the backlight power supply chip receives a pulse-width modulation (English: Pulse-Width Modulation, PWM for short) signal sent by the backlight controller. The backlight power supply chip outputs a drive current to the backlight LED according to the pulse-width modulation signal. The backlight LED emits a backlight according to the drive current. A magnitude of a drive current and a backlight intensity are in a positively correlated relationship, that is, a larger drive current indicates a higher backlight intensity, and a smaller drive current indicates a lower backlight intensity.

Limited by hardware performance of a backlight power supply chip, a magnitude of a drive current that is output by the backlight power supply chip falls within a limited range. As a result, backlight luminance that is output by a backlight LED also falls within a limited luminance range. In other words, the lowest luminance or the highest luminance that is output by the backlight LED is not expected ideal luminance of developers in design or limiting luminance that can be actually output by the backlight LED.

SUMMARY

To resolve a problem that luminance that is output by a backlight LED falls within a limited luminance range because a backlight power supply chip can output a drive current only in a limited current value adjustment range due to limited hardware performance of the backlight power supply chip. Embodiments of the present invention provide a backlight circuit, an electronic device, and a backlight adjustment method. The technical solutions are as follows:

According to a first aspect, an embodiment of the present invention provides a backlight circuit, where the backlight circuit includes a backlight power supply chip and an adjustable resistor circuit; the backlight power supply chip includes a set pin configured to set a reference current, an input pin, and an output pin; one end of the adjustable resistor circuit is connected to the set pin, the other end of the adjustable resistor circuit is grounded, the adjustable resistor circuit includes a first resistor branch and a second resistor branch, and the first resistor branch and the second resistor branch have different resistance values, which are used to generate different reference currents; the adjustable resistor circuit includes a control end, where the control end is configured to receive a switching signal, and switch, according to the switching signal, a resistor branch connected to the set pin between the first resistor branch and the second resistor branch; and the backlight power supply chip is configured to generate a drive current based on the reference current and according to a duty cycle of a PWM signal received by the input pin, and output the drive current by using the output pin, where the drive current is used to drive a backlight source to send a backlight.

In the backlight circuit provided in the first aspect, a set pin of a backlight power supply chip is connected to an adjustable resistor circuit, and the adjustable resistor circuit switches, according to a switching signal, a resistor branch connected to the set pin between a first resistor branch and a second resistor branch, so as to change a reference current in the backlight power supply chip, thereby changing a current value adjustment range of a drive current because the drive current is generated based on the reference current. This resolves a problem that luminance that is output by a backlight source falls within a limited luminance range because the backlight power supply chip can output a drive current only in a limited current value adjustment range due to limited hardware performance of the backlight power supply chip, and changes a reference current in a backlight power supply by using different resistor branches, so as to output a drive current in a larger current value adjustment range, so that a backlight intensity reaches lower luminance or higher luminance.

In a first possible implementation of the first aspect, the adjustable resistor circuit includes a selector switch and at least two resistor branches, any one of the at least two resistor branches is the first resistor branch, and the other of the at least two resistor branches is the second resistor branch; the selector switch includes the control end and a selection end; and the selection end is configured to: switch, according to the switching signal received by the control end, a resistor branch connected to the set pin between the first resistor branch and the second resistor branch. In the implementation, a selector switch and at least two resistor branches are disposed in the adjustable resistor circuit, so that three resistor branches, four resistor branches, or even more resistor branches are implemented in the adjustable resistor circuit, so as to implement a larger current value adjustment range for a drive current.

With reference to the first possible implementation of the first aspect, in a second possible implementation, the adjustable resistor circuit includes a first resistor and a second resistor that are connected in series; the first resistor and the second resistor form the first resistor branch, and the second resistor forms the second resistor branch; or the first resistor and the second resistor form the second resistor branch, and the second resistor forms the first resistor branch. In the implementation, a resistor branch in the adjustable resistor circuit is implemented by using a series circuit, so that a circuit has a simple form, and is easily designed on a circuit board and produced.

With reference to the first possible implementation of the first aspect, in a third possible implementation, the adjustable resistor circuit includes a third resistor and a fourth resistor that are connected in parallel; the third resistor forms the first resistor branch; and the fourth resistor forms the second resistor branch. In the implementation, a resistor branch in the adjustable resistor circuit is implemented by using a parallel circuit, so that a circuit has a simple form, and is easily designed on a circuit board and produced.

With reference to the first aspect, or the first possible implementation of the first aspect, or the second possible implementation of the first aspect, or the third possible implementation of the first aspect, in a fifth possible implementation, the switching signal is sent by a backlight controller when a resistor branch corresponding to an expected luminance value is different from the resistor branch connected to the set pin; and the expected luminance value is used to indicate expected backlight luminance emitted by the backlight source.

According to a second aspect, an embodiment of the present invention provides an electronic device, where the electronic device includes a backlight controller, a memory, and the backlight circuit and the backlight source provided in the first aspect or any possible implementation of the first aspect, the memory is connected to the backlight controller, and the memory stores an executable program of the backlight controller;

the backlight controller is connected to the input pin of the backlight circuit, and is configured to send the PWM signal to the backlight power supply chip; and the backlight controller is connected to the control end in the backlight circuit, and is configured to send the switching signal to the adjustable resistor circuit; and the output pin of the backlight power supply chip in the backlight circuit is connected to the backlight source, where the backlight source is configured to emit a backlight according to the drive current.

In a first possible implementation of the second aspect, the backlight controller is a central processing unit (English: Central Processing Unit, CPU for short), or the backlight controller 220 is a graphics processing unit (English: Graphics Processing Unit, GPU for short), or the backlight controller 220 is an LCD driver integrated circuit (English: Driver integrated circuit, Drive IC for short).

In a second possible implementation of the second aspect, the backlight controller is configured to execute an instruction in the memory, and the backlight controller implements the backlight adjustment method provided in the following third aspect, or any possible implementation of the third aspect by executing the instruction.

According to a third aspect, an embodiment of the present invention provides a backlight adjustment method, applied to the backlight controller of the electronic device according to the second aspect, where the method includes: obtaining, by the backlight controller, an expected luminance value, where the expected luminance value is used to indicate expected backlight luminance emitted by the backlight source; determining, by the backlight controller, a resistor branch corresponding to the expected luminance value, where the resistor branch is either of the first resistor branch or the second resistor branch; when the resistor branch corresponding to the expected luminance value is different from a resistor branch connected to the set pin, sending, by the backlight controller, a switching signal to a control end of the adjustable resistor circuit; and sending, by the backlight controller, a PWM signal to the backlight power supply chip, where a duty cycle of the PWM signal is corresponding to the expected luminance value, the backlight power supply chip is configured to generate a drive current based on the reference current and according to the duty cycle of the PWM signal, and send the drive current to the backlight source, and the backlight source is configured to emit a backlight according to the drive current.

According to the backlight adjustment method provided in the third aspect, a backlight controller obtains an expected luminance value; and when a resistor branch corresponding to the expected luminance value is different from a resistor branch connected to a set pin, sends a switching signal to a control end of an adjustable resistor circuit. The adjustable resistor circuit switches, according to the switching signal, the resistor branch connected to the set pin between a first resistor branch and a second resistor branch, so as to change a reference current in a backlight power supply chip, thereby changing a current value adjustment range of the drive current because a drive current is generated based on the reference current. This resolves a problem that luminance that is output by a backlight source falls within a limited luminance range because the backlight power supply chip can output a drive current only in a limited current value adjustment range due to limited hardware performance of the backlight power supply chip, and changes a reference current in a backlight power supply by using different resistor branches, so as to output a drive current in a larger current value adjustment range, so that a backlight intensity reaches lower luminance or higher luminance.

In a first possible implementation of the third aspect, before sending the switching signal to the control end of the adjustable resistor circuit, the method further includes: if the resistor branch connected to the set pin is the first resistor branch, and a resistance value of the first resistor branch is greater than a resistance value of the second resistor branch, gradually increase a duty cycle of a currently output PWM signal to a maximum duty $cycle_1$, where the maximum duty $cycle_1$ is a maximum duty cycle when the set pin is connected to the first resistor branch; or if the resistor branch connected to the set pin is the first resistor branch, and a resistance value of the first resistor branch is less than a resistance value of the second resistor branch, gradually decrease a duty cycle of a currently output PWM signal to a minimum duty $cycle_1$, where the minimum duty $cycle_1$ is a minimum duty cycle when the set pin is connected to the first resistor branch; or if the resistor branch connected to the set pin is the second resistor branch, and a resistance value of the first resistor branch is greater than a resistance value of the second resistor branch, gradually decrease a duty cycle of a currently output PWM signal to a minimum duty $cycle_2$, where the minimum duty $cycle_2$ is a minimum duty cycle when the set pin is connected to the second resistor branch; or if the resistor branch connected to the set pin is the second resistor branch, and a resistance value of the first resistor branch is less than a resistance value of the second resistor branch, gradually increase a duty cycle of a currently output PWM signal to a maximum duty $cycle_2$, where the maximum duty $cycle_2$ is a maximum duty cycle when the set pin is connected to the second resistor branch. In the implementation, the PWM signal gradually changes before the switching signal is sent, and the backlight luminance is not suddenly changed, thereby avoiding backlight luminance flickering.

In a second possible implementation of the third aspect, the sending the PWM signal to the backlight power supply chip, where a duty cycle of the PWM signal is corresponding to the expected luminance value includes: querying the duty cycle corresponding to the expected luminance value; and when a resistor branch connected to the set pin after switching is the second resistor branch, and a resistance value of the first resistor branch is greater than a resistance value of the second resistor branch, gradually increasing a duty cycle of a currently output PWM signal from a minimum duty $cycle_2$ to the duty cycle, where the minimum duty $cycle_2$ is a minimum duty cycle when the set pin is connected to the second resistor branch; or when a resistor branch connected to the set pin after switching is the second resistor branch, and a resistance value of the first resistor branch is less than a resistance value of the second resistor branch, gradually decreasing a duty cycle of a currently output PWM signal from a maximum duty $cycle_2$ to the duty cycle, where the maximum duty $cycle_2$ is a maximum duty cycle when the set pin is connected to the second resistor branch; or when a resistor branch connected to the set pin after switching is the first resistor branch, and a resistance value of the first resistor branch is greater than a resistance value of the second resistor branch, gradually decreasing a duty cycle of a currently output PWM signal from a maximum duty $cycle_1$ to the duty cycle, where the maximum duty $cycle_1$ is a maximum duty cycle when the set pin is connected to the first resistor branch; or when a resistor branch connected to the set pin after switching is the first resistor branch, and a resistance value of the first resistor branch is less than a resistance value of the second resistor branch, gradually increasing a minimum duty $cycle_1$ of a currently output PWM signal to the duty cycle, where the minimum duty $cycle_1$ is a minimum duty cycle when the set pin is connected to the first resistor branch. In the implementation, the PWM signal gradually changes after the switching signal is sent, and the backlight luminance is not suddenly changed, thereby avoiding backlight luminance flickering.

With reference to all the foregoing aspects or all the possible implementations of all the aspects, in a possible implementation, a resistance value R1 of the first resistor branch and a resistance value R2 of the second resistor branch meet the following conditions:

$$R1 \geq R2 \times \text{maximum duty cycle}_2/\text{minimum duty cycle}_1,$$

or $$R1 \leq R2 \times \text{minimum duty cycle}_1/\text{maximum duty cycle}_2,$$

wherein the minimum duty $cycle_1$ is the minimum duty cycle when the set pin is connected to the first resistor branch; the maximum duty $cycle_1$ is the maximum duty cycle when the set pin is connected to the first resistor branch; the minimum duty $cycle_2$ is the minimum duty cycle when the set pin is connected to the second resistor branch; and the maximum duty $cycle_2$ is the maximum duty cycle when the set pin is connected to the second resistor branch. In the implementation, it is assumed that $R1=R2\times$maximum duty $cycle_2$/minimum duty $cycle_1$ or $R1=R2\times$minimum duty $cycle_1$/maximum duty $cycle_2$, so that a current value adjustment range corresponding to the first resistor branch and a current value adjustment range corresponding to the second resistor branch can be combined into a continuous current value adjustment range, so as to implement a current value adjustment range with a larger change range. According to the current value adjustment range with the larger change range, there is no flickering when switching is performed between the first resistor branch and the second resistor branch.

BRIEF DESCRIPTION OF DRAWINGS

To describe the technical solutions in the embodiments of the present invention more clearly, the following briefly describes the accompanying drawings required for describing the embodiments. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

To make the objectives, technical solutions, and advantages of the present invention clearer, the following further describes the embodiments of the present invention in detail with reference to the accompanying drawings.

Figure 1:
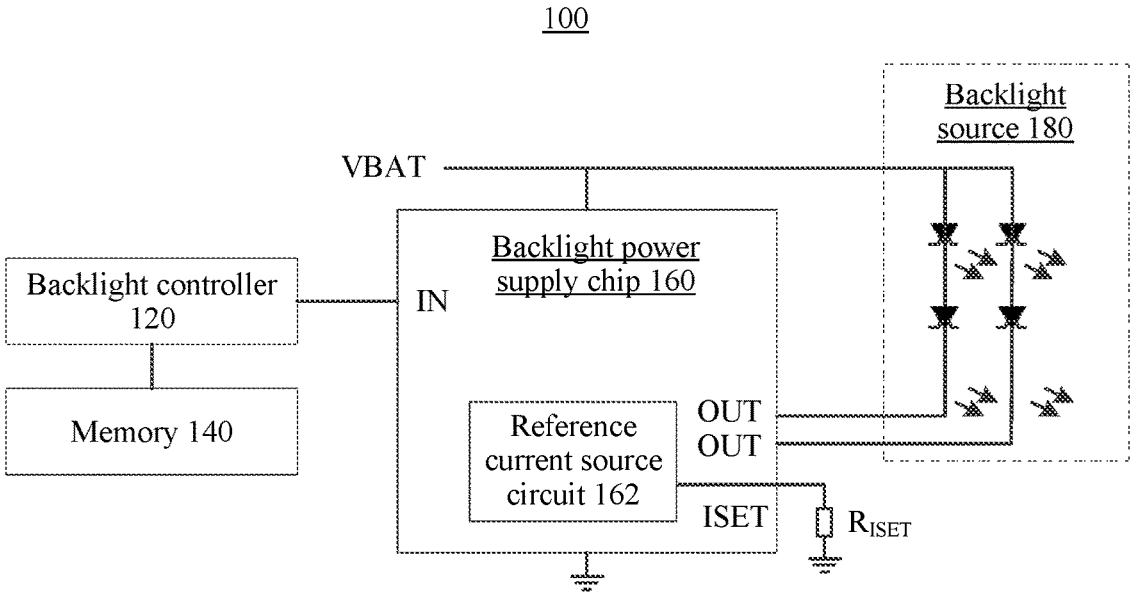
FIG. 1 is a schematic structural diagram of an existing electronic device.

Referring to FIG. 1, FIG. 1 shows a schematic structural diagram of an existing electronic device 100. The electronic device 100 includes a backlight controller 120, a memory 140, a backlight power supply chip 160, and a backlight source 180.

The backlight controller 120 may be a central processing unit (English: Central Processing Unit, CPU for short), or the backlight controller 120 may be a graphics processing unit (English: Graphics Processing Unit, GPU for short), or the backlight controller 120 may be an LCD driver integrated circuit (English: Driver integrated circuit, Drive IC for short).

The memory 140 stores an executable instruction of the backlight controller 120. The memory 140 may be implemented by any type of or a combination of a volatile storage device and a non-volatile storage device, such as a static random access memory (English: Static Random Access Memory, SRAM for short), an electrically erasable programmable read-only memory (English: Electrically Erasable Programmable Read-Only Memory, EEPROM for short), an erasable programmable read only memory (English: Erasable Programmable Read Only Memory, EPROM for short), a programmable read-only memory (English: Programmable Read-Only Memory, PROM for short), a read-only memory (English: Read Only Memory, ROM for short), a magnetic memory, a flash memory, a magnetic disk, or an optical disc.

The backlight power supply chip 160 is an integrated circuit chip of outputting a drive current based on a PWM signal. The backlight power supply chip 160 includes an input pin IN, a set pin ISET, and an output pin OUT. An inside of the backlight power supply chip 160 includes a reference current source circuit 162.

The input pin IN is connected to the backlight controller 120.

The set pin ISET is connected to the reference current source circuit 162 inside the backlight power supply chip 160. The set pin ISET is further connected to one end of a resistor $R_{ISET}$ outside the backlight power supply chip 160, and the other end of the resistor $R_{ISET}$ is grounded.

The reference current source circuit 162 is configured to provide a reference current $I_{FB_full}$, and a formula for calculating the reference current is as follows:

$$I_{FB_fall}=V_{ISET_full}/R_{ISET}\times K_{ISET_full} \quad \text{Formula 1}$$

The $V_{ISET_full}$ is a reference voltage whose voltage value is fixed and unchanged. The $K_{ISET_full}$ is a fixed parameter, and the $K_{ISET_full}$ is determined by electrical performance of an electronic element in the reference current source circuit 162. Apparently, because all three parameters of the $V_{ISET_full}$, the $R_{ISET}$, and the $K_{ISET_full}$ are fixed values, a current value of the reference current provided by the reference current source circuit 162 is also a fixed value.

In addition, one pin of the backlight power supply chip 160 is connected to a power supply VBAT, and the other pin is grounded.

The backlight source 180 generally is a backlight LED. One end of the backlight source 180 is connected to the power supply VBAT, and the other end is connected to the input pin OUT of the backlight power supply chip 160.

During operation, the backlight controller 140 generates an expected luminance value according to a predetermined backlight control policy. The expected luminance value is backlight luminance that is expected by the backlight controller 120 and that is emitted by the backlight source 180. For example, the predetermined backlight control policy is: when luminance of ambient light becomes dark, an expected luminance value is reduced; and when luminance of ambient light becomes bright, an expected luminance value is increased.

The expected luminance value is generally represented in a binary numeral of 9 bits or 11 bits, and is stored in a backlight register Reg_Iset. In this embodiment, representation by using 9 bits is used as an example. The expected luminance value is 000000000, that is, 0 in decimal notation; or the expected luminance value is 111111111, that is, 511 in decimal notation. It should be noted that the expected luminance value is only a representation manner of a luminance level or a luminance tap position, and is not equal to a luminance value in an actual physical quantity.

The backlight controller 140 queries a duty cycle corresponding to the expected luminance value from a pre-stored "expected luminance value—duty cycle" correspondence table. The "expected luminance value—duty cycle" correspondence table is stored in the memory 140. Table 1 shows the "expected luminance value—duty cycle" correspondence table as an example. For ease of reading and understanding, all expected luminance values are represented in decimal notation in the following description.

TABLE 1

| "Expected luminance value—duty cycle" correspondence table | | Current value of a drive current (it is assumed that a reference current is |
|---|---|---|
| Expected luminance value | Duty cycle | equal to 20 mA) |
| 0 | 1% | 0.2 mA |
| 1 | 1.19% | 0.238 mA |
| 2 | 1.38% | 0.276 mA |
| 3 | 1.57% | 0.314 mA |
| 4 | 1.76% | 0.352 |
| . . . | . . . | . . . |
| 511 | 100% | 20 mA |

Apparently, because a value range of the expected luminance value is [0, 511] and a value range of the duty cycle is [1%, 100%], an adjustment step of a duty cycle between two adjacent expected luminance values is approximately 0.19%. The backlight controller 140 sends a PWM signal that meets the duty cycle to the input pin of the backlight power supply chip 160. For example, an expected luminance value is 4, and the backlight controller 140 sends a PWM signal whose duty cycle is 1.76% to the input pin of the backlight power supply chip 160.

After receiving the PWM signal, the backlight power supply chip 160 generates a drive current based on a reference current and according to a duty cycle of the PWM signal. A magnitude of the drive current and a duty cycle of a PWM signal are in a direct proportion relationship. A formula for calculating a current value of the drive current is as follows:

$$I_{FBX}=I_{FB_full}\times \text{Duty}. \quad \text{Formula 2}$$

The $I_{FB_full}$ is a reference current and the Duty is a duty cycle.

For example, if a duty cycle of the PWM signal is 1% and a reference current is 20 mA, a drive current=20 mA×1%=0.2 mA. For another example, if a duty cycle of the PWM signal is 100% and a reference current is 20 mA, a drive current=20 mA×100%=20 mA.

Limited by physical performance of the backlight power supply chip 160, a minimum duty cycle that can be received by the backlight power supply chip 160 is 1%; therefore, a minimum drive current that can be output by the backlight power supply chip 160 is approximately equal to 1%×reference current, and a maximum drive current is approximately equal to 100%×reference current, that is, a current value adjustment range of the drive current is [1%×$I_{FB_full}$, 100%×$I_{FB_full}$]. With reference to the example in Table 1, the current value adjustment range is [2 mA, 20 mA]. Apparently, the current value adjustment range is relatively limited.

Because the current value adjustment range of the drive current is relatively limited, in some dark conditions, although a minimum drive current is used to drive the backlight source 180, a backlight emitted by the backlight source 180 is still quite strong, thereby dazzling eyes of a user. Likewise, in some light conditions, although a maximum drive current is used to drive the backlight source 180, a backlight emitted by the backlight source 180 is still too weak to clearly see content displayed on a liquid crystal display.

In addition, maximum adjustment steps in the current value adjustment range are 512 steps, and a change of a current value of a drive current between two adjacent backlight luminance values is approximately 0.19%×reference current.

According to the foregoing formula 2, it can be learned that a current value of a drive current is related to a reference current. To obtain a drive current with a smaller current value or a drive current with a larger current value, an embodiment of the present invention provides a technical solution in which a drive current with a larger current value range is obtained based on a change of a reference current. In addition, with reference to the foregoing formula 1, it can be learned that if a reference current needs to be changed, a resistance value of a resistor $R_{ISET}$ may be changed. Based on the foregoing idea, the following embodiment is provided.

Figure 2:
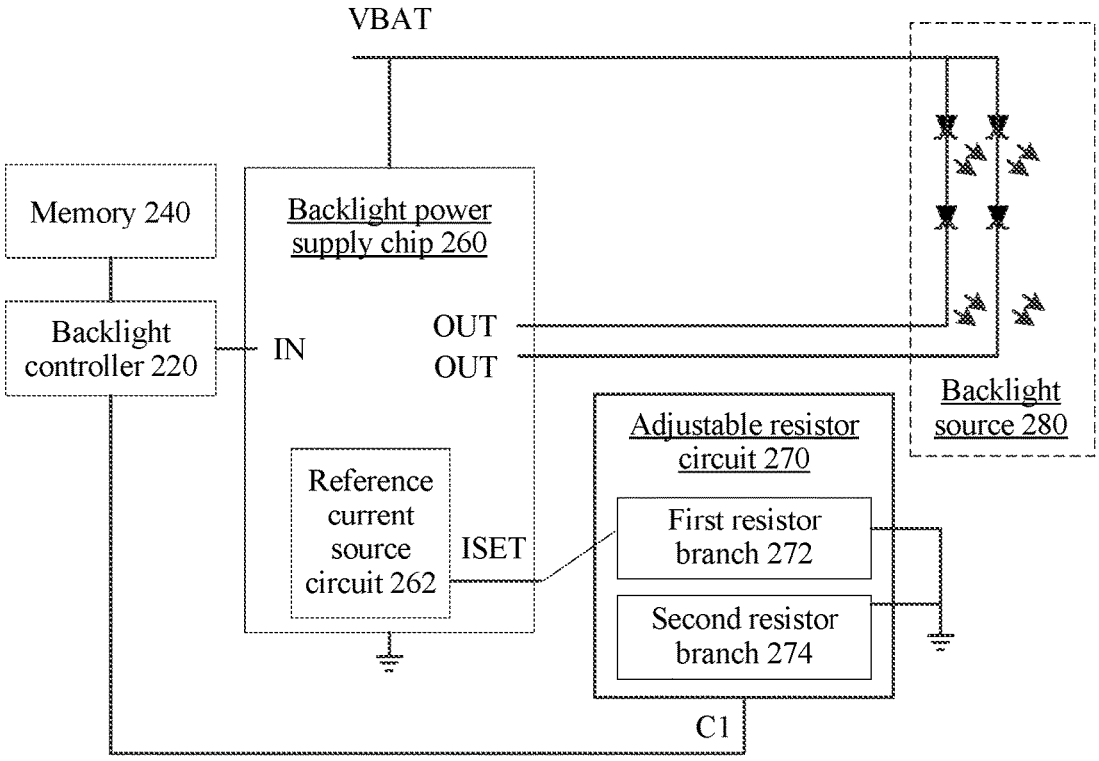
FIG. 2 is a schematic structural diagram of an electronic device according to an embodiment of the present invention.

Referring to FIG. 2, FIG. 2 shows a schematic structural diagram of an electronic device 200 according to an embodiment of the present invention. The electronic device 200 includes a backlight controller 220, a memory 240, a backlight power supply chip 260, an adjustable resistor circuit 270, and a backlight source 280.

The backlight controller 220 may be a central processing unit (English: Central Processing Unit, CPU for short), or the backlight controller 220 may be a graphics processing unit (English: Graphics Processing Unit, GPU for short), or the backlight controller 220 may be an LCD driver integrated circuit (English: Driver integrated circuit, Drive IC for short).

The memory 240 stores an executable instruction of the backlight controller 220. The memory 240 may be implemented by any type of or a combination of a volatile storage device and a non-volatile storage device, such as a static random access memory (English: Static Random Access Memory, SRAM for short), an electrically erasable programmable read-only memory (English: Electrically Erasable Programmable Read-Only Memory, EEPROM for short), an erasable programmable read only memory (English: Erasable Programmable Read Only Memory, EPROM for short), a programmable read-only memory (English: Programmable Read-Only Memory, PROM for short), a read-only memory (English: Read Only Memory, ROM for short), a magnetic memory, a flash memory, a magnetic disk, or an optical disc.

The backlight power supply chip 260 includes an input pin IN, a set pin ISET configured to set a reference current, and an output pin OUT. The inside of the backlight power supply chip 260 further includes a reference current source circuit 262.

The input pin IN is connected to the backlight controller 220. During operation, the backlight controller 220 is configured to send a PWM signal to the input pin IN.

One end of the adjustable resistor circuit 270 is connected to the set pin ISET, and the other end of the adjustable resistor circuit 270 is grounded. The adjustable resistor circuit 270 includes a first resistor branch 272 and a second resistor branch 274. A resistance value of the first resistor branch 272 is different from a resistance value of the second resistor branch 274. It should be noted that although FIG. 2 shows the first resistor branch 272 and the second resistor branch 274, but this does not constitute a limitation on a quantity of resistor branches. For example, FIG. 3A further shows multiple resistor branches including another resistor branch.

The adjustable resistor circuit 270 includes a control end C1. The control end C1 is connected to the backlight controller 220. When an adjustment range of a drive current needs to be changed, the backlight controller 220 is configured to send a switching signal to the control end C1.

The control end C1 is configured to receive the switching signal, and switch, according to the switching signal, a resistor branch connected to the set pin ISET from the first resistor branch 272 to the second resistor branch 274. The backlight power supply chip 260 includes the reference current source circuit 262, and the reference current source circuit 262 is configured to provide a reference current. When a resistance value of the resistor branch connected to the set pin ISET changes, a current value of the reference current in the backlight power supply chip 260 also changes. A magnitude of the reference current and the resistance value of the resistor branch connected to the set pin ISET are in an inverse proportion relationship.

The output pin OUT of the backlight power supply chip 260 is connected to one end of the backlight source 280. The backlight source 280 generally is a backlight LED. Optionally, the other end of the backlight source 280 is connected to a power supply VBAT.

Optionally, the backlight power supply chip 260 and the adjustable resistor circuit 270 may be integrated on a main board of the electronic device. The backlight controller 220, the memory 240, and another electronic device are generally disposed on the main board. The backlight power supply chip 260 is an integrated circuit chip disposed on the main board. The backlight power supply chip 260 is electrically connected to the adjustable resistor circuit 270 by using a conductive line on the main board.

Optionally, the set pin ISET may have different names in different embodiments, for example, a full scale set pin, but all the set pins are pins configured to set a reference current. No specific limitation is imposed on a name of the set pin ISET in this embodiment.

Figure 3A:
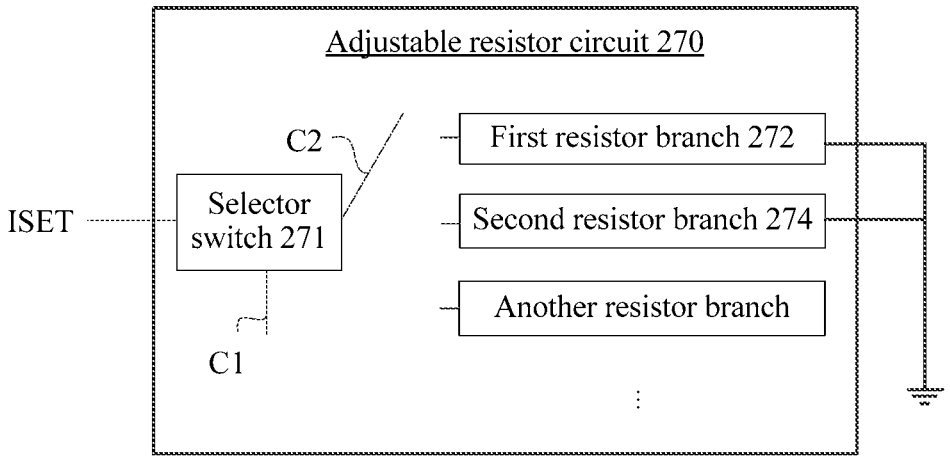
FIG. 3A is a schematic structural diagram of an adjustable resistor circuit according to an embodiment of the present invention.

With reference to FIG. 3A, FIG. 3A shows a schematic structural diagram of an adjustable resistor circuit 270 as an example. The adjustable resistor circuit 270 includes a selector switch 271, the first resistor branch 272, and the second resistor branch 274.

The selector switch 271 includes the control end C1 and a selection end C2.

The control end C1 is configured to connect to the backlight controller 220.

The selection end C2 is configured to connect, according to a switching signal received by the control end C1, the set pin ISET and either of the first resistor branch 272 or the second resistor branch 272.

Optionally, in a light condition, the selection end C2 connects, according to the switching signal received by the control end C1, the set pin ISET and a resistor branch with a smaller resistance value, so that a current value of the reference current in the backlight power supply chip 260 is a larger current value, so as to output a larger drive current in a condition of a same duty cycle and obtain higher backlight luminance. In a dark condition, the selection end C2 connects, according to the switching signal received by the control end C1, the set pin ISET and a resistor branch with a larger resistance value, so that a current value of the reference current in the backlight power supply chip 260 is a smaller current value, so as to output a smaller drive current in a condition of a same duty cycle and obtain lower backlight luminance.

Optionally, the control end C1 is a control end C1 that meets the General Purpose Input/Output (English: General Purpose Input Output, GPIO for short).

Optionally, there are two resistor branches in the adjustable resistor circuit 270. However, three, four, or more resistor branches may be disposed according to an embodiment requirement. In this embodiment, no limitation is imposed on a quantity of resistor branches in the adjustable resistor circuit 270.

Optionally, the adjustable resistor circuit 270 is implemented by using an integrated variable resistor.

Optionally, resistor branches in the adjustable resistor circuit 270 are implemented by using a series circuit or a parallel circuit.

Figure 3B:
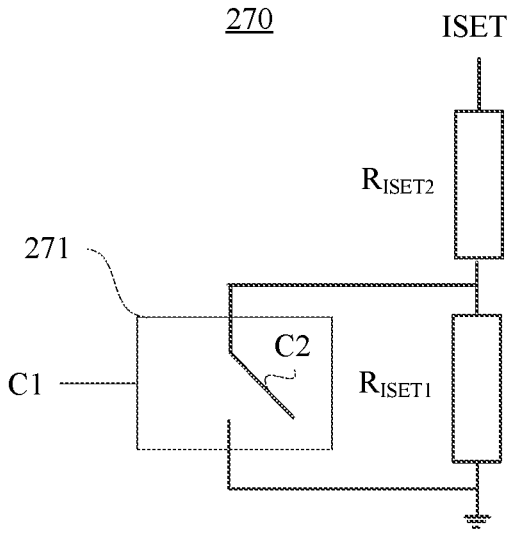
FIG. 3B is a schematic structural diagram of an adjustable resistor circuit according to another embodiment of the present invention.

For example, with reference to FIG. 3B, FIG. 3B shows a schematic structural diagram of an adjustable resistor circuit 270 that is implemented by using a series circuit. The adjustable resistor circuit 270 includes the selector switch 271, a first resistor $R_{ISET1}$ and a second resistor $R_{ISET2}$ that are connected in series.

The first resistor $R_{ISET1}$ and the second resistor $R_{ISET2}$ form the second resistor branch 274, and the second resistor $R_{ISET2}$ forms the first resistor branch 272.

One end of the second resistor $R_{ISET2}$ is connected to the set pin ISET, the other end of the second resistor $R_{ISET2}$ is connected to one end of the first resistor $R_{ISET1}$, and the other end of the first resistor $R_{ISET1}$ is grounded. According to the switching signal received by the control end C1, when the selection end C2 in the selector switch 271 is disabled, the set pin ISET is connected to the second resistor branch 274; when the selection end C2 in the selector switch 271 is enabled, the set pin ISET is connected to the first resistor branch 272.

Figure 3C:
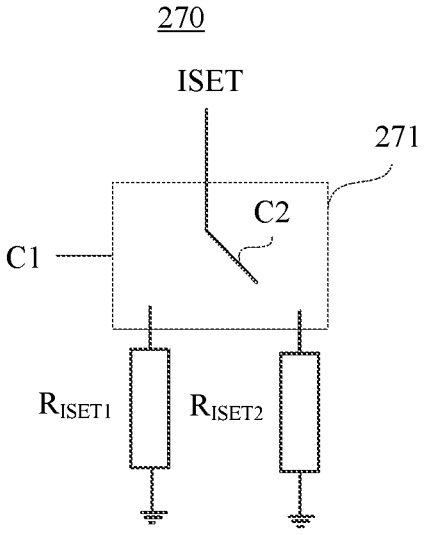
FIG. 3C is a schematic structural diagram of an adjustable resistor circuit according to another embodiment of the present invention.

For example, with reference to FIG. 3C, FIG. 3C shows a schematic structural diagram of an adjustable resistor circuit 270 that is implemented by using a parallel circuit. The adjustable resistor circuit 270 includes the selector switch 271, a third resistor $R_{ISET1}$ and a fourth resistor $R_{ISET2}$ that are connected in parallel.

The third resistor $R_{ISET1}$ forms the first resistor branch 272, and the fourth resistor $R_{ISET2}$ forms the second resistor branch 274. The third resistor $R_{ISET1}$ and the fourth resistor $R_{ISET2}$ have different resistance values.

One end of the third resistor $R_{ISET1}$ and one end of the fourth resistor $R_{ISET2}$ are grounded. The other end of the third resistor $R_{ISET1}$ and the other end of the fourth resistor $R_{ISET2}$ are connected to the set pin ISET by using the selection end C2 of the selector switch 271. According to the switching signal received by the control end C1, when the selection end in the selector switch 271 is connected to the third resistor $R_{ISET1}$, the set pin ISET is connected to the first resistor branch 272; when the selection end in the selector switch 271 is connected to the fourth resistor $R_{ISET2}$, the set pin ISET is connected to the second resistor branch 274.

A person skilled in the art can foresee that there are multiple implementations of the adjustable resistor circuit 270. This embodiment shows only two implementations of the adjustable resistor circuit 270 as an example, and no limitation is imposed on a specific implementation of the adjustable resistor circuit 270.

According to formula 2, it can be learned that when a value range of the duty cycle is unchanged, after the current value of the reference current changes, the current value adjustment range of the drive current is increased from one current value adjustment range shown in FIG. 1 [minimum duty cycle$\times I_{FB_full}$, maximum duty cycle$\times I_{FB_full}$] to two current value adjustment ranges [minimum duty cycle$_1\times I_1$, maximum duty cycle$_1\times I_1$] and [minimum duty cycle$_2\times I_2$, maximum duty cycle$_2\times I_2$]. The $I_1$ is a reference current when the set pin ISET is connected to the first resistor branch 272, and the $I_2$ is a reference current when the set pin ISET is connected to the second resistor branch 274.

It is assumed that a resistance value of the first resistor branch 272 is R1, and a resistance value of the second resistor branch 274 is R2.

To ensure that a maximum drive current in the current value adjustment range [minimum duty cycle$_1\times I_1$, maximum duty cycle$_1\times I_1$] is less than or equal to a minimum drive current in the current value adjustment range [minimum duty cycle$_2\times I_2$, maximum duty cycle$_2\times I_2$], that is, a maximum duty cycle$_1\times I_1\leq$a minimum duty cycle$_2\times I_2$, with reference to formula 1, the R1 and the R2 need to meet the following condition:

$$R1\geq R2\times\text{maximum duty cycle}_2/\text{minimum duty cycle}_1.$$

Alternatively, to ensure that a minimum drive current in the current value adjustment range [minimum duty cycle$_1\times I_1$, maximum duty cycle$_1\times I_1$] is greater than or equal to a maximum drive current in the current value adjustment range [minimum duty cycle$_2\times I_2$, maximum duty cycle$_2\times I_2$], that is, a minimum duty cycle$_1\times I_1\geq$a maximum duty cycle$_2\times I_2$, with reference to formula 1, the R1 and the R2 need to meet the following condition:

$$R1\leq R2\times\text{minimum duty cycle}_1/\text{maximum duty cycle}_2.$$

It should be noted that the minimum duty cycle$_1$ and the minimum duty cycle$_2$ usually are the same, and both of them are 1%. However, in a possible embodiment, the minimum duty cycle$_1$ and the minimum duty cycle$_2$ may be different, for example, the minimum duty cycle$_1$=10% and the minimum duty cycle$_2$=1%. Likewise, the maximum duty cycle$_1$ and the maximum duty cycle$_2$ usually are the same, and both of them are 100%. However, in a possible embodiment, the maximum duty cycle$_1$ and the maximum duty cycle$_2$ may be different, for example, the maximum duty cycle$_1$=100% and the maximum duty cycle$_2$=90%. This is not limited in this embodiment. In this embodiment, description is given by using an example in which the minimum duty cycle$_1$ and the minimum duty cycle$_2$ are the same, and both of them are 1%, and the maximum duty cycle$_1$ and the maximum duty cycle$_2$ usually are the same, and both of them are 100%.

In this embodiment, an example in which R1=R2×maximum duty cycle$_2$/minimum duty cycle$_1$ is used for description. It is assumed that $V_{ISET_full}$=1.229 V, $K_{ISET_full}$=1030, $R_1$=6340 K, and $R_2$=63.4 K. A current value adjustment range corresponding to the first resistor branch 272 is [0.002 mA, 0.2 mA], and a current value adjustment range corresponding to the second resistor branch 274 is [0.2 mA, 20 mA].

To perform backlight adjustment by using two resistor branches in the adjustable resistor circuit 270, the memory 240 may store three correspondence tables. The three correspondence tables are respectively a summary correspondence table between an expected luminance value and a subtable luminance value, a first "subtable luminance value—duty cycle" correspondence table, and a second "subtable luminance value—duty cycle" correspondence table. The first "subtable luminance value—duty cycle" correspondence table may be referred to as a first correspondence table for short. The second "subtable luminance value—duty cycle" correspondence table may be referred to as a second correspondence table for short. It is easily understood that the correspondence table is used to describe only a correspondence, and a presentation form of the correspondence table is not limited to a table. In addition, for ease of understanding and description, three correspondence tables are used in this embodiment. This does not constitute a limitation on a quantity of tables, and the three correspondence tables may also be integrated into one table.

The summary correspondence table between an expected luminance value and a subtable luminance value may be referred to as a summary table for short. An expected luminance value in a part of a value range of the expected luminance value in the summary table is corresponding to a subtable luminance value in the first correspondence table, that is, the expected luminance value in the part of the value range is corresponding to the first resistor branch. An expected luminance value in another part of the value range of the expected luminance value in the summary table is corresponding to a subtable luminance value in the second correspondence table, that is, the expected luminance value in the another part of the value range is corresponding to the second resistor branch. For example, the summary table is shown in Table 2:

TABLE 2

| Expected luminance value | Subtable luminance value in the first correspondence table |
|---|---|
| 0 | 0 |
| 1 | 2 |
| 2 | 4 |
| 3 | 6 |
| . . . | . . . |
| 254 | 509 |
| 255 | 511 |

| Expected luminance value | Subtable luminance value in the second correspondence table |
|---|---|
| 256 | 0 |
| 257 | 2 |
| 258 | 4 |
| 259 | 6 |
| . . . | . . . |
| 510 | 509 |
| 511 | 511 |

In Table 2, when an expected luminance value is from 0 to 255, the expected luminance value is corresponding to the first resistor branch. In this case, a correspondence between an expected luminance value and a subtable luminance value in the first correspondence table is as follows: the subtable luminance value=a rounded-off value of the expected luminance value/255×511. When an expected luminance value is from 256 to 511, the expected luminance value is corresponding to the second resistor branch. In this case, a correspondence between an expected luminance value and a subtable luminance value in the second correspondence table is as follows: the subtable luminance value=a rounded-off value of (the expected luminance value−256)/255×511.

The first correspondence table is a "subtable luminance value—duty cycle" correspondence table that is actually used when the set pin ISET of the backlight power supply chip 260 is connected to the first resistor branch. For example, the first correspondence table is shown in Table 3:

TABLE 3

| First correspondence table | | Current value of a |
|---|---|---|
| Subtable luminance value | Duty cycle | drive current |
| 0 | 1% | 0.002 mA |
| 1 | 1.19% | 0.00238 mA |
| 2 | 1.38% | 0.00276 mA |
| 3 | 1.57% | 0.00314 mA |
| 4 | 1.76% | 0.00352 mA |
| . . . | . . . | . . . |
| 511 | 100% | 0.2 mA |

The second "expected luminance value—duty cycle" correspondence table may be referred to as a second correspondence table for short. The second correspondence table is an "expected luminance value—duty cycle" correspondence table that needs to be used when the set pin of the backlight power supply chip 260 is connected to the second resistor branch. For example, the second correspondence table is shown in Table 4:

TABLE 4

| Second correspondence table | | |
|---|---|---|
| Subtable luminance value | Duty cycle | Current value of a drive current |
| 0 | 1% | 0.2 mA |
| 1 | 1.19% | 0.238 mA |
| 2 | 1.38% | 0.276 mA |
| 3 | 1.57% | 0.314 mA |
| 4 | 1.76% | 0.352 mA |
| . . . | . . . | . . . |
| 511 | 100% | 20 mA |

A specific manner of adjusting a backlight by the backlight controller 220 is as follows:

When the electronic device 200 is powered on, the backlight controller 220 reads a default expected luminance value (a preconfigured value or a value when the electronic device 200 is switched off last time) from a backlight register Reg_Iset. For example, an expected luminance value is 259, and the expected luminance value 259 in the summary table is corresponding to a subtable luminance value 6 in the second correspondence table, that is, the expected luminance value 259 is corresponding to the second resistor branch 274. The backlight controller 220 controls the second resistor branch 274 in the adjustable resistor circuit 270 to connect to the set pin ISET. In addition, the backlight controller 220 finds, in the second correspondence table, that a duty cycle corresponding to the subtable luminance value 6 is 2.14%, and then the backlight controller 220 sends a PWM signal whose duty cycle is 2.14% to the input pin IN of the backlight power supply chip 260. In this case, a reference current in the backlight power supply chip 260 is 20 mA, a drive current of 20×2.14%=4.28 mA is output by using the output pin OUT, and the backlight source 280 externally outputs a backlight according to the drive current of 4.28 mA.

In an operation process of the electronic device 200, three factors may result in a change of an expected luminance value:

First, a user manually changes an expected luminance value.

Figure 4:
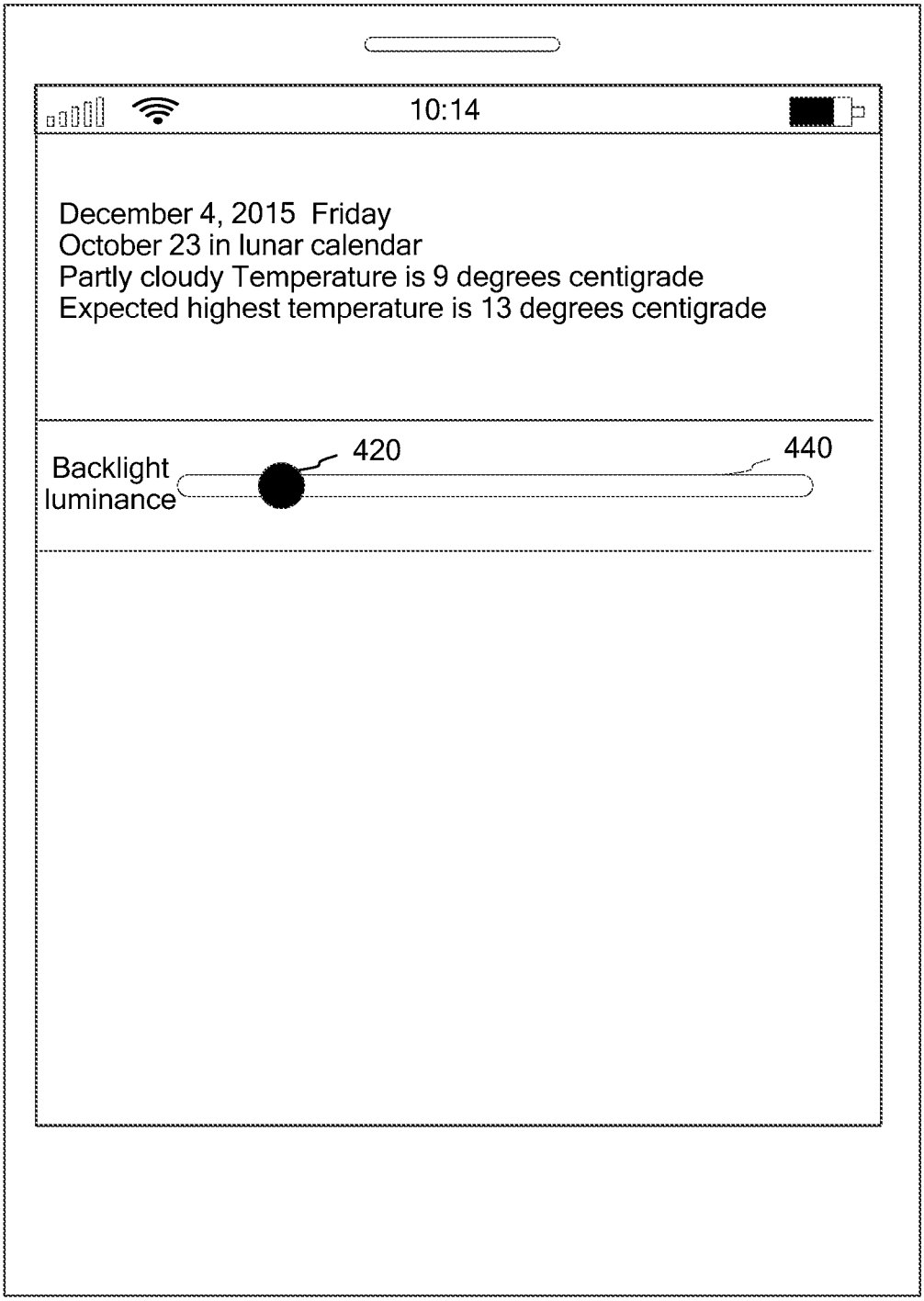
FIG. 4 is a schematic structural diagram of an electronic device according to an embodiment of the present invention.

An adjustment control of backlight luminance is provided in a setting interface of an electronic device. The adjustment control generally is a drag adjustment control, including a button 420 and a drag bar 440, as shown in FIG. 4. The user drags the button 420 to different positions of the drag bar 440, to change the expected luminance value.

Second, an application program changes an expected luminance value according to control logic of the application program.

Adjustment performed by the backlight controller 220 on the expected luminance value is controlling at an operating system level. The operating system includes an application layer, and various application programs run at the application layer, for example, an instant messaging program, an e-book reading program, a phone program, and a short message service program. An application program changes an expected luminance value according to control logic of the application program. For example, when the application program is the e-book reading program, in a night reading mode, the expected luminance value is changed to 50. For another example, when the application program is the phone program, in a call mode, the expected luminance value is changed to 0.

Third, an operating system changes an expected luminance value according to an ambient light intensity.

A light sensor is usually further disposed on an electronic device, and the ambient light intensity is collected by using the light sensor. The operating system can change the expected luminance value according to the ambient light intensity. For example, when the ambient light intensity is A, the expected luminance value is set to 100; and when the ambient light intensity is B, the expected luminance value is set to 200.

No limitation is imposed on a manner of changing an expected luminance value in this embodiment.

In a possible embodiment, a default expected luminance value 259 is manually changed by the user to 258. The backlight controller 220 finds, in the summary table, that a subtable luminance value corresponding to the expected luminance value 258 is 4 in the second correspondence table, that is, a resistor branch corresponding to the expected luminance value 258 is the second resistor branch 274. In this case, because a resistor branch connected to the set pin ISET is the second resistor branch 274, the resistor branch does not need to be switched. The backlight controller 220 finds, in the second correspondence table, that a duty cycle corresponding to the subtable luminance value 4 is 1.76%, and then the backlight controller 220 sends a PWM signal whose duty cycle is 1.76% to the input pin IN of the backlight power supply chip 260. In this case, a reference current in the backlight power supply chip 260 is 20 mA, a drive current of 20×1.76%=0.352 mA is output by using the output pin OUT, and the backlight source 280 externally outputs a backlight according to the drive current of 0.352 mA.

In another possible embodiment, a default expected luminance value 259 is manually changed by the user to 50. The backlight controller 220 finds, in the summary table, that a subtable luminance value corresponding to the expected luminance value 50 is 100 in the first correspondence table, that is, a resistor branch corresponding to the expected luminance value 50 is the first resistor branch 272. In this case, because a resistor branch connected to the set pin ISET is the second resistor branch 274, the backlight controller 220 needs to switch the second resistor branch 274 connected to the set pin ISET to the first resistor branch 272. The backlight controller 220 first sends a switching signal to the control end C1 of the adjustable resistor circuit 270. After receiving the switching signal, the adjustable resistor circuit 270 connects the set pin ISET and the first resistor branch 272. The backlight controller 220 then finds, in the first correspondence table, that a duty cycle corresponding to the subtable luminance value 100 is 20%, and then the backlight controller 220 sends a PWM signal whose duty cycle is 20% to the input pin IN of the backlight power supply chip 260. In this case, a reference current in the backlight power supply chip 260 is 0.2 mA, a drive current of 0.2×20%=0.04 mA is output by using the output pin OUT, and the backlight source 280 externally outputs a backlight according to the drive current of 0.04 mA.

If an expected luminance value is manually changed by the user from 50 to 260, the backlight controller 220 finds, in the summary table, that a subtable luminance value corresponding to the expected luminance value 260 is 8 in the second correspondence table, that is, a resistor branch corresponding to the expected luminance value 260 is the second resistor branch 274. In this case, because a resistor branch connected to the set pin ISET is the first resistor branch 272, the backlight controller 220 needs to switch the first resistor branch 272 connected to the set pin ISET to the second resistor branch 274. The backlight controller 220 first sends a switching signal to the control end C1 of the adjustable resistor circuit 270. After receiving the switching signal, the adjustable resistor circuit 270 connects the second resistor branch 274 and the set pin ISET. The backlight controller 220 then finds, in the second correspondence table, that a duty cycle corresponding to the subtable luminance value 8 is 2.52%, and then the backlight controller 220 sends a PWM signal whose duty cycle is 2.52% to the input pin IN of the backlight power supply chip 260. In this case, a reference current in the backlight power supply chip 260 is 20 mA, a drive current of 20×2.52%=0.504 mA is output by using the output pin OUT, and the backlight source 280 externally outputs a backlight according to the drive current of 0.504 mA.

However, in experiment, an engineer finds that when an expected luminance value is directly switched from 50 to 260, because a drive current is suddenly changed from 0.04 mA to 0.504 mA, and a change amplitude is more than 10 times, from a perspective of a user, a backlight abruptly becomes bright after flickering. The flickering of the backlight dazzles eyes of the user, and accelerates consumption of a physical life of the backlight source 280. In a more preferred embodiment, a drive current needs to be gradually changed, so that the eyes of the user can better adapt to a backlight change process, and the physical life of the backlight source 280 is protected.

Specifically, if an expected luminance value is manually changed by the user from 50 to 260, the backlight controller 220 finds, in the summary table, that a subtable luminance value corresponding to the expected luminance value 50 is 100 in the first correspondence table, that is, a subtable luminance value corresponding to the expected luminance value 260 is 8 in the second correspondence table.

Before sending the switching signal, the backlight controller 220 gradually increases a duty cycle of a currently output PWM signal before switching to a maximum duty $cycle_1$ 100%. Details are as follows:

The backlight controller 220 first adds 1 to a subtable luminance value 100 in the first correspondence table, to obtain a subtable luminance value 101; finds, in the first correspondence table, that a duty cycle corresponding to the subtable luminance value 101 is 20.19%; and sends a PWM signal whose duty cycle is 20.19% to the input pin IN. In this case, a drive current is 0.04038 mA.

The backlight controller 220 then adds 1 to a subtable luminance value 101 in the first correspondence table, to obtain a subtable luminance value 102; finds, in the first correspondence table, that a duty cycle corresponding to the subtable luminance value 102 is 20.38%; and sends a PWM signal whose duty cycle is 20.38% to the input pin IN. In this case, a drive current is 0.04076 mA.

The backlight controller 220 then adds 1 to a subtable luminance value 102 in the first correspondence table, to obtain a subtable luminance value 103; finds, in the first correspondence table, that a duty cycle corresponding to the subtable luminance value 103 is 20.57%; and sends a PWM signal whose duty cycle is 20.57% to the input pin IN. In this case, a drive current is 0.04114 mA.

Figure 5:
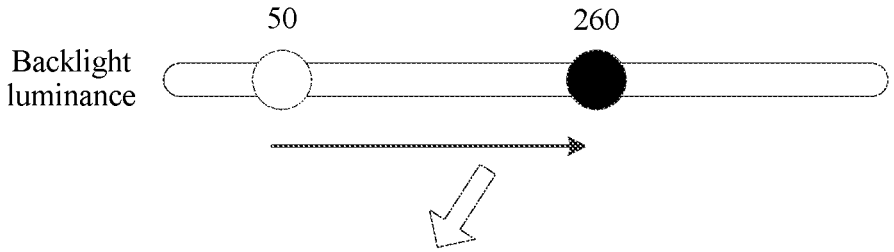
FIG. 5 is a schematic principle diagram when an electronic device shown in FIG. 4 performs backlight adjustment.
Figure 5:
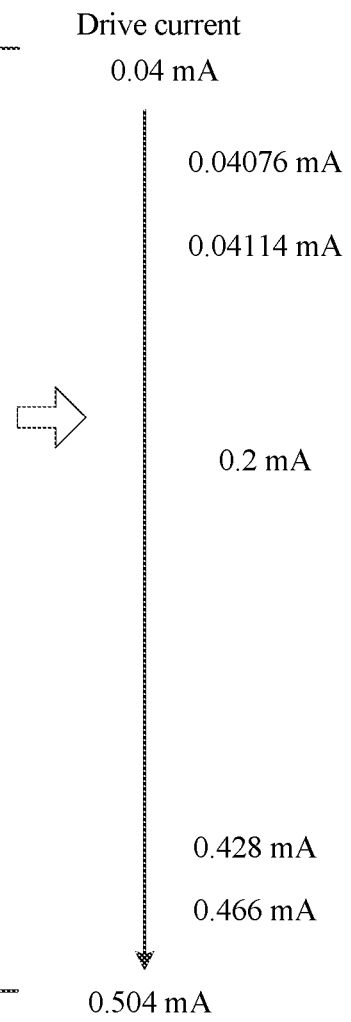

By analogy, when successively adding 1 to a subtable luminance value until to obtain a maximum value 511 in the first correspondence table, the backlight controller 220 outputs a PWM signal whose duty cycle is 100%. In this case, a drive current is 0.2 mA, as shown in FIG. 5.

After sending the switching signal, the backlight controller 220 further needs to gradually increase a duty cycle of a PWM signal that is output after switching from a minimum duty $cycle_2$ to a duty cycle 2.52% corresponding to the expected luminance value 260. Details are as follows:

When the subtable luminance value is increased to the maximum value 511 in the first correspondence table, the backlight controller 220 sends a switching signal to the control end C1 of the adjustable resistor circuit 270. After receiving the switching signal, the adjustable resistor circuit 270 connects the second resistor branch 274 and the set pin ISET After the first resistor branch 272 is switched to the second resistor branch 274, the backlight controller 220 updates the subtable luminance value into a minimum subtable luminance value 0 in the second correspondence table; finds, in the second correspondence table, that a duty cycle corresponding to the subtable luminance value 0 is a minimum duty $cycle_2$ 1%; and sends a PWM signal whose duty cycle is 1% to the input pin IN. In this case, a drive current is 0.2 mA.

The backlight controller 220 adds 1 to a subtable luminance value 0 in the second correspondence table, to obtain a subtable luminance value 1; finds, in the second correspondence table, that a duty cycle corresponding to the subtable luminance value 1 is 1.19%; and sends a PWM signal whose duty cycle is 1.19% to the input pin IN. In this case, a drive current is 0.238 mA.

By analogy, when successively adding 1 to a subtable luminance value until to obtain a subtable luminance value 8 in the second correspondence table, the backlight controller 220 sends a PWM signal whose duty cycle is 2.52% to the input pin IN. In this case, a drive current is 0.504 mA.

Apparently, a drive current is gradually increased from 0.04 mA, 0.04038 mA, 0.04076 mA, . . . , 0.2 mA, 0.238 mA, . . . , to 0.504 mA. From a perspective of a user, a backlight gradually becomes bright. There is no flickering, and the physical life of the backlight source 280 can be protected.

In addition, the user is quite sensitive to a backlight change in a dark environment. However, because an adjustment step between two adjacent drive currents in the first correspondence table is 0.00038 mA, and an adjustment step between two adjacent drive currents in the second correspondence table is 0.038 mA, in this embodiment of the present invention, an adjustment step in lower backlight luminance is less than an adjustment step in higher backlight luminance. The user is not likely to perceive a change between two adjacent drive currents. That is, a backlight gradient process in the lower backlight luminance is finer and softer.

It should be noted that, in the backlight adjustment process, a smaller expected luminance value may be adjusted to a larger expected luminance value, or a larger expected luminance value may be adjusted to a smaller expected luminance value.

In conclusion, in the electronic device provided in this embodiment of the present invention, a set pin of a backlight power supply chip is connected to an adjustable resistor circuit, and the adjustable resistor circuit switches, according to a switching signal, a resistor branch connected to the set pin from a first resistor branch to a second resistor branch, so as to change a reference current in the backlight power supply chip, thereby changing a current value adjustment range of a drive current. This resolves a problem that luminance that is output by a backlight LED falls within a limited luminance range because the backlight power supply chip can output a drive current only in a limited current value adjustment range due to limited hardware performance of the backlight power supply chip, and changes a reference current in a backlight power supply by using different resistor branches, so as to output a drive current in a larger current value adjustment range, so that a backlight intensity reaches lower luminance or higher luminance.

According to the electronic device provided in this embodiment of the present invention, it may be set that R1=R2×maximum duty $cycle_2$/minimum duty $cycle_1$ or R1=R2×minimum duty cycles/maximum duty $cycle_2$, so that a current value adjustment range corresponding to a first resistor branch and a current value adjustment range corresponding to a second resistor branch can be combined into a continuous current value adjustment range, so as to implement a current value adjustment range with a larger change range. According to the current value adjustment range with the larger change range, there is no flickering when switching is performed between the first resistor branch and the second resistor branch.

According to the electronic device provided in this embodiment of the present invention, in a process in which an expected luminance value is changed from a first subtable luminance value to a second subtable luminance value, the first subtable luminance value is gradually changed to the second subtable luminance value by gradually adding 1 or gradually subtracting 1, so that a drive current is gradually changed, a backlight is gradually changed, and eyes of a user may better adapt to a backlight change process, and a physical life of a backlight source is protected.

According to the electronic device provided in this embodiment of the present invention, in a smaller current value adjustment range, an adjustment step between two adjacent drive currents is smaller, so that although a user is quite sensitive to a backlight change in a dark environment, the user is not likely to perceive a change between two adjacent drive currents. That is, a backlight gradient process in lower backlight luminance is finer and softer.

With reference to FIG. 5, it can be learned that because both a first correspondence table and a second correspondence table have 512 subtable luminance values, the backlight controller 220 has a capability of adjusting backlight luminance at 1024 luminance levels. However, the memory 240 needs to store three tables: a summary table, the first correspondence table, and the second correspondence table. In an optional embodiment, the summary table, the first correspondence table, and the second correspondence table can be integrated into one table. If a backlight register is still 9 bits, the table is shown in Table 5.

TABLE 5

| Expected luminance value | Duty cycle |
|---|---|
| 0 | 1% |
| 1 | 1.38% |
| 2 | 1.76% |
| 3 | 2.14% |
| . . . | . . . |
| 255 | 100% |
| 256 | 0% |
| . . . | . . . |
| 511 | 100% |

In this case, an adjustment step between two adjacent duty cycles is changed from 0.19% to 0.38%, and the backlight controller 220 can adjust backlight luminance only at 512 luminance levels. A resistor branch corresponding to an expected luminance value [0, 255] is a first resistor branch, and a resistor branch corresponding to an expected luminance value [256, 511] is a second resistor branch.

It should be noted that because a resistance value R1 of the first resistor branch and a resistance value R2 of the second resistor branch are different, for a current value adjustment range corresponding to the first resistor branch and a current value adjustment range corresponding to the second resistor branch, there may be three cases:

First, the two current value adjustment ranges are not intersected to each other. In this case, R1>R2×maximum duty $cycle_2$/minimum duty cycles; or R1<R2×minimum duty cycles/maximum duty $cycle_2$. For example, a current value adjustment range corresponding to the first resistor branch 272 is [0.0015 mA, 0.15 mA], and a current value adjustment range corresponding to the second resistor branch 274 is [0.16 mA, 16 mA]. Optionally, when a range between the two current value adjustment ranges is relatively small, for example, a difference between 0.15 mA and 0.16 mA is only 0.01 mA, a drive current jump is relatively weak when the two resistor branches are switched, and therefore a user hardly observes the jump.

Second, the two current value adjustment ranges are intersected in a boundary value. In this case, R1=R2× maximum duty $cycle_2$/minimum duty cycles; or R1=R2× minimum duty cycles/maximum duty $cycle_2$. For example, a current value adjustment range corresponding to the first resistor branch 272 is [0.0015 mA, 0.15 mA], and a current value adjustment range corresponding to the second resistor branch 274 is [0.15 mA, 15 mA]. When the two resistor branches are switched, there is no drive current transition, that is, the two current value adjustment ranges may be connected to form a continuous current value adjustment range.

Third, the two current value adjustment ranges are intersected in a segment of an interval. For example, a current value adjustment range corresponding to the first resistor branch is [0.0015 mA, 0.15 mA], and a current value adjustment range corresponding to the second resistor branch is [0.10 mA, 10 mA]. In this case, a minimum duty cycle and/or a maximum duty cycle of a current value adjustment range in a correspondence table are/is changed in advance, so that the two current value adjustment ranges are not intersected to each other or are intersected only in a boundary value. For example, a minimum duty cycle of the second resistor branch is changed, so that a current value adjustment range corresponding to the second resistor branch is changed to [0.15 mA, 10 mA].

Figure 6:
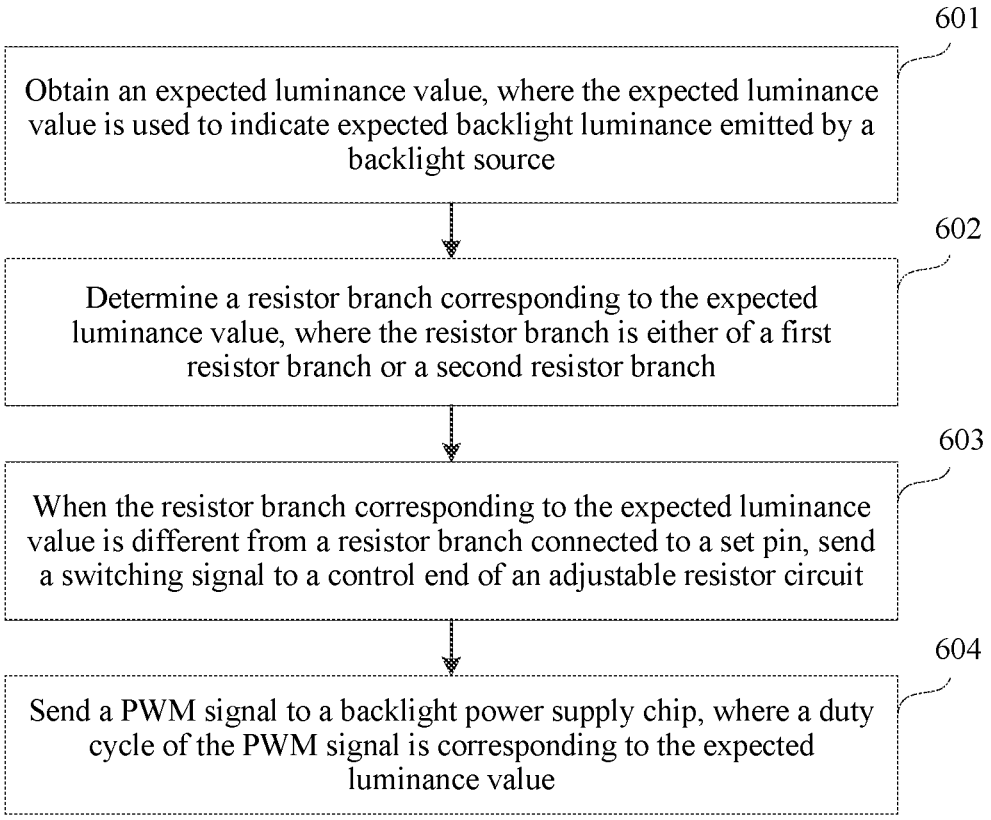
FIG. 6 is a flowchart of a backlight adjustment method according to an embodiment of the present invention.

A method for performing backlight adjustment by a backlight controller is summarized. Referring to FIG. 6, FIG. 6 shows a method flowchart of a backlight adjustment method according to an embodiment of the present invention. The method may be executed by the backlight controller 220 provided in the embodiment shown in FIG. 2. The method includes the following steps.

Step 601: Obtain an expected luminance value, where the expected luminance value is used to indicate expected backlight luminance emitted by a backlight source.

When an electronic device is powered on, the expected luminance value is a default expected luminance value.

In a running process of an electronic device, changing an expected luminance value includes but is not limited to the following three manners:

First, a user manually changes an expected luminance value.

Second, an application program changes an expected luminance value according to control logic of the application program.

Third, an operating system changes an expected luminance value according to an ambient light intensity.

Step 602: Determine a resistor branch corresponding to the expected luminance value, where the resistor branch is either of a first resistor branch or a second resistor branch.

The backlight controller determines, by querying the summary table shown in Table 2, or the correspondence table shown in Table 5, the resistor branch corresponding to the expected luminance value.

Step 603: When the resistor branch corresponding to the expected luminance value is different from a resistor branch connected to a set pin, send a switching signal to a control end of an adjustable resistor circuit.

Step 604: Send a PWM signal to a backlight power supply chip, where a duty cycle of the PWM signal is corresponding to the expected luminance value.

The backlight controller determines, by querying the first correspondence table shown in Table 3, or the second correspondence table shown in Table 4, or the correspondence table shown in Table 5, a duty cycle corresponding to the expected luminance value. The backlight controller then sends a PWM signal that meets the duty cycle to an input pin IN of the backlight power supply chip.

The backlight power supply chip is configured to generate a drive current based on a reference current and according to a duty cycle of a PWM signal, and send the drive current to a backlight source, where the backlight source is configured to emit a backlight according to the drive current.

In conclusion, according to the backlight adjustment method provided in this embodiment, a backlight controller obtains an expected luminance value; and when a resistor branch corresponding to the expected luminance value is different from a resistor branch connected to a set pin, sends a switching signal to a control end of an adjustable resistor circuit. The adjustable resistor circuit switches, according to the switching signal, the resistor branch connected to the set pin between a first resistor branch and a second resistor branch, so as to change a reference current in a backlight power supply chip, thereby changing a current value adjustment range of the drive current because a drive current is generated based on the reference current. This resolves a problem that luminance that is output by a backlight source falls within a limited luminance range because the backlight power supply chip can output a drive current only in a limited current value adjustment range due to limited hardware performance of the backlight power supply chip, and changes a reference current in a backlight power supply by using different resistor branches, so as to output a drive current in a larger current value adjustment range, so that a backlight intensity reaches lower luminance or higher luminance.

To avoid a sudden change of backlight luminance and flickering, the backlight controller may further perform gradient adjustment on the drive current in a backlight switching process.

Because there are two resistance value conditions R1>R2 and R1<R2 and two adjustment cases in which a smaller expected luminance value is adjusted to a larger expected luminance value, or a larger expected luminance value is adjusted to a smaller expected luminance value, there are four possible embodiments in total.

In a first embodiment, R1>R2, and a smaller expected luminance value corresponding to the first resistor branch is adjusted to a larger expected luminance value corresponding to the second resistor branch.

In a second embodiment, R1<R2, and a larger expected luminance value corresponding to the first resistor branch is adjusted to a smaller expected luminance value corresponding to the second resistor branch.

In a third embodiment, R1>R2, and a larger expected luminance value corresponding to the second resistor branch is adjusted to a smaller expected luminance value corresponding to the first resistor branch.

In a fourth embodiment, R1<R2, and a smaller expected luminance value corresponding to the second resistor branch is adjusted to a larger expected luminance value corresponding to the first resistor branch.

Figure 7A:
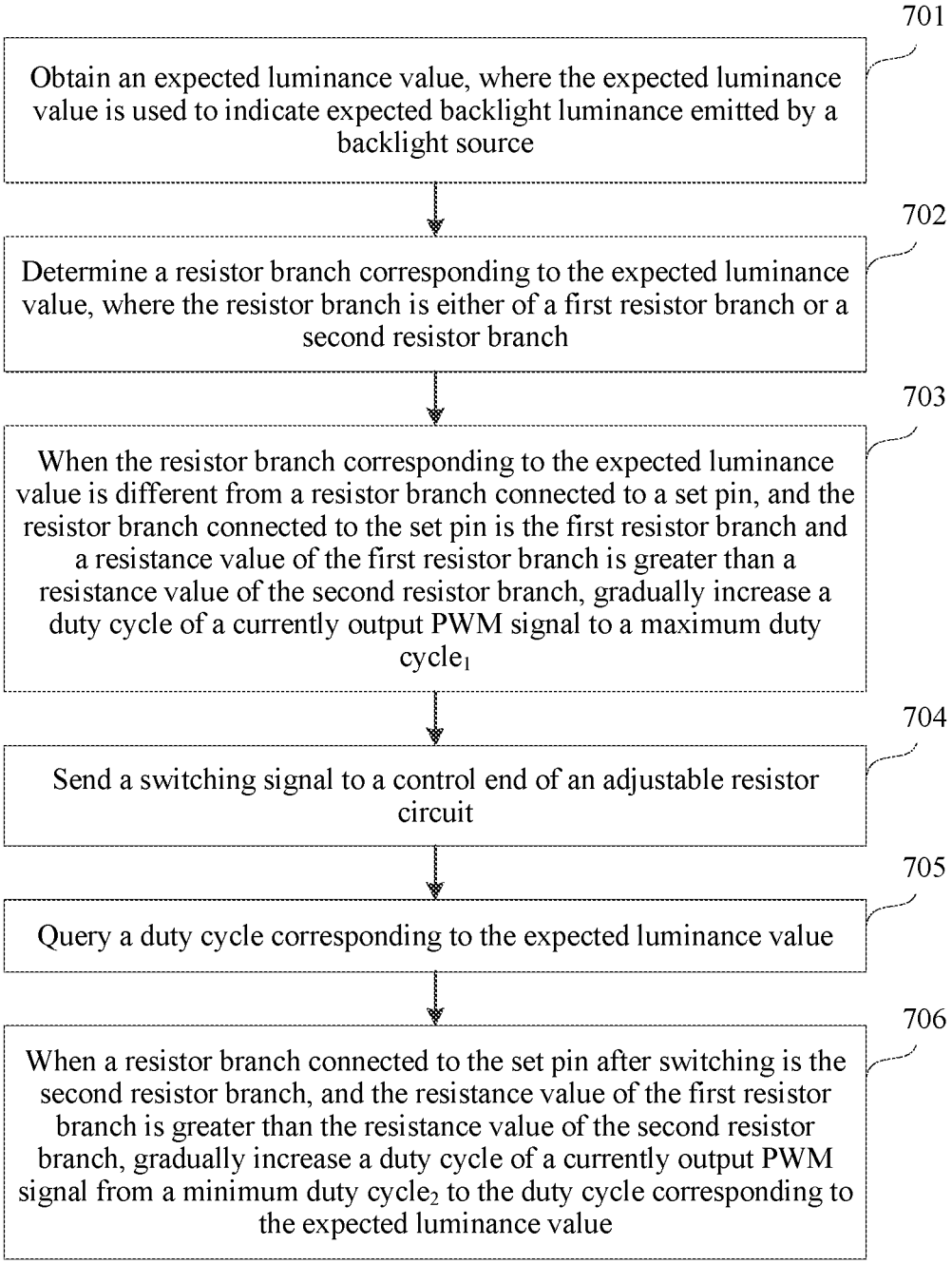
FIG. 7A is a flowchart of a backlight adjustment method according to an embodiment of the present invention.

Referring to FIG. 7A, FIG. 7A shows a flowchart of a backlight adjustment method according to another embodiment of the present invention. The method may be executed by the backlight controller 220 provided in the embodiment shown in FIG. 2 and is used to implement the backlight adjustment in the foregoing first embodiment. The method includes the following steps.

Step 701: Obtain an expected luminance value, where the expected luminance value is used to indicate expected backlight luminance emitted by a backlight source.

When an electronic device is powered on, the expected luminance value is a default expected luminance value.

In a running process of an electronic device, changing an expected luminance value includes but is not limited to the following three manners:

First, a user manually changes an expected luminance value.

Second, an application program changes an expected luminance value according to control logic of the application program.

Third, an operating system changes an expected luminance value according to an ambient light intensity.

Step 702: Determine a resistor branch corresponding to the expected luminance value, where the resistor branch is either of a first resistor branch or a second resistor branch.

The backlight controller determines, by querying the summary table shown in Table 2, or the correspondence table shown in Table 5, the resistor branch corresponding to the expected luminance value.

Step 703: When the resistor branch corresponding to the expected luminance value is different from a resistor branch connected to a set pin, and the resistor branch connected to the set pin is the first resistor branch and a resistance value of the first resistor branch is greater than a resistance value of the second resistor branch, gradually increase a duty cycle of a currently output PWM signal to a maximum duty cycles.

The maximum duty $cycle_1$ is a maximum duty cycle when the set pin is connected to the first resistor branch.

An adjustment step that is used when the backlight controller gradually increases the duty cycle of the currently output PWM signal to the maximum duty $cycle_1$ is not limited. The adjustment step may be a difference between duty cycles corresponding to two adjacent subtable luminance values, for example, 0.19% shown in Table 3 or Table 4; or the adjustment step may be a difference between duty cycles corresponding to two adjacent expected luminance values, for example, 0.38% shown in Table 5; or the adjustment step may be another possible value.

Step 704: Send a switching signal to a control end of an adjustable resistor circuit.

When a resistor branch connected to the set pin is the first resistor branch, the switching signal is used to trigger the adjustable resistor circuit to connect the second resistor branch and the set pin.

When a resistor branch connected to the set pin is the second resistor branch, the switching signal is used to trigger the adjustable resistor circuit to connect the first resistor branch and the set pin.

Step 705: Query a duty cycle corresponding to the expected luminance value.

The backlight controller queries, in the summary table, a first correspondence table, and a second correspondence table, the duty cycle corresponding to the expected luminance value; or the backlight controller queries, in the correspondence table shown in Table 5, the duty cycle corresponding to the expected luminance value.

Step 706: When a resistor branch connected to the set pin after switching is the second resistor branch, and the resistance value of the first resistor branch is greater than the resistance value of the second resistor branch, gradually increase a duty cycle of a currently output PWM signal from a minimum duty $cycle_2$ to the duty cycle corresponding to the expected luminance value.

The minimum duty $cycle_2$ is a minimum duty cycle when the set pin is connected to the second resistor branch.

An adjustment step that is used when the backlight controller gradually increases the minimum duty $cycle_2$ of the currently output PWM signal to the duty cycle corresponding to the expected luminance value is not limited. The adjustment step may be a difference between duty cycles corresponding to two adjacent subtable luminance values, for example, 0.19% shown in Table 3 or Table 4; or the adjustment step may be a difference between duty cycles corresponding to two adjacent expected luminance values, for example, 0.38% shown in Table 5; or the adjustment step may be another possible value.

In conclusion, according to the backlight adjustment method provided in this embodiment, a PWM signal gradually changes according to step 703 before a switching signal is sent, and backlight luminance is not suddenly changed, thereby avoiding backlight luminance flickering. The PWM signal gradually changes according to step 706 after the switching signal is sent, and the backlight luminance is not suddenly changed, thereby avoiding the backlight luminance flickering.

Figure 7B:
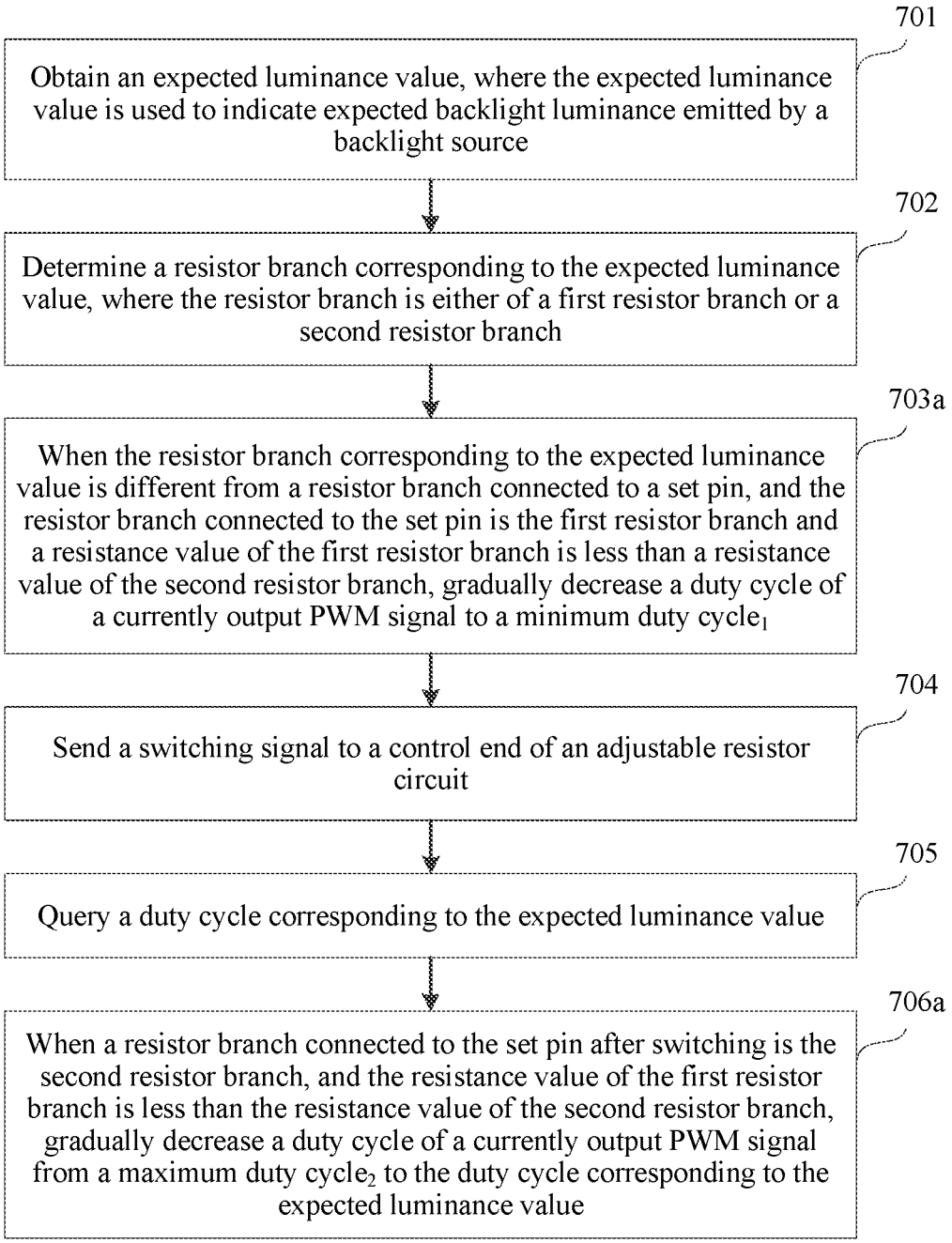
FIG. 7B is a flowchart of a backlight adjustment method according to an embodiment of the present invention.

Likewise, for a second embodiment, step 703 may be replaced with step 703*a*, and step 706 may be replaced with step 706*a*, which as shown in FIG. 7B.

Step 703*a*: When the resistor branch corresponding to the expected luminance value is different from a resistor branch connected to a set pin, and the resistor branch connected to the set pin is the first resistor branch and a resistance value of the first resistor branch is less than a resistance value of the second resistor branch, gradually decrease a duty cycle of a currently output PWM signal to a minimum duty $cycle_1$.

The minimum duty $cycle_1$ is a maximum duty cycle when the set pin is connected to the first resistor branch.

Step 706*a*: When a resistor branch connected to the set pin after switching is the second resistor branch, and the resistance value of the first resistor branch is less than the resistance value of the second resistor branch, gradually decrease a duty cycle of a currently output PWM signal from a maximum duty $cycle_2$ to the duty cycle corresponding to the expected luminance value.

The maximum duty $cycle_2$ is a maximum duty cycle when the set pin is connected to the second resistor branch.

Figure 7C:
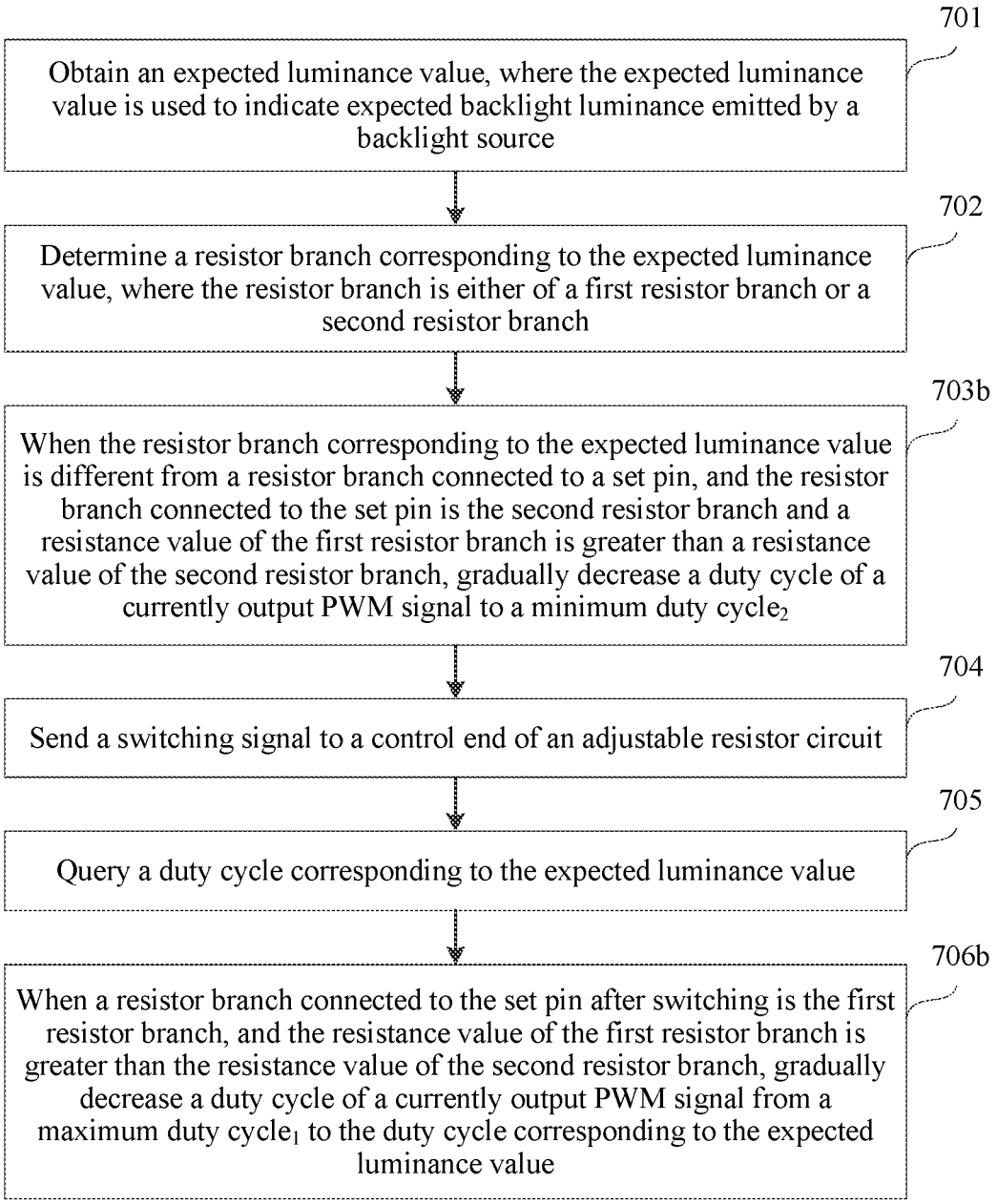
FIG. 7C is a flowchart of a backlight adjustment method according to an embodiment of the present invention.
Figure 7D:
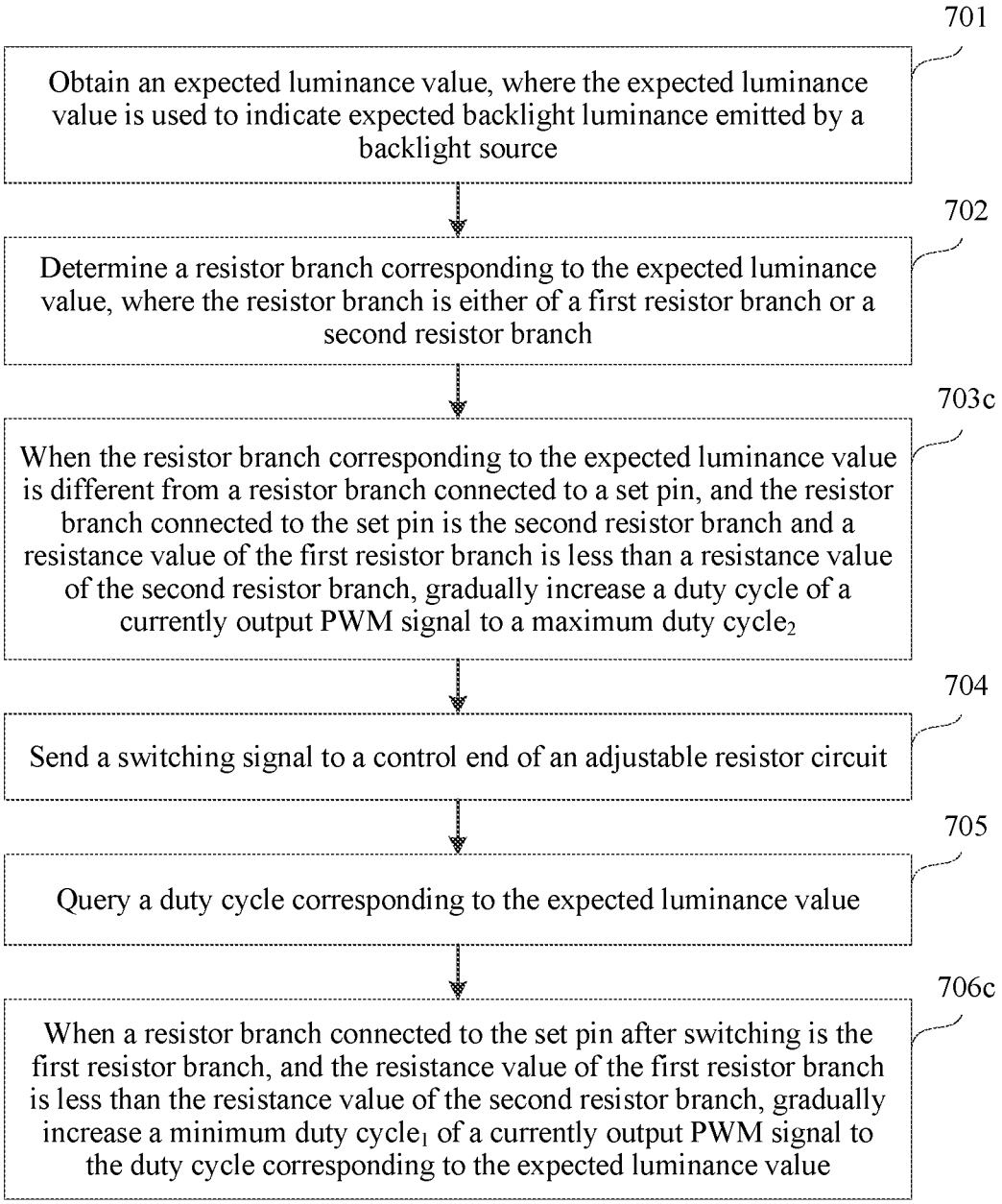
FIG. 7D is a flowchart of a backlight adjustment method according to an embodiment of the present invention.

Likewise, for a third embodiment, step 703 may be replaced with step 703*b*, and step 706 may be replaced with step 706*b*, which as shown in FIG. 7*c*.

Step 703*b*: When the resistor branch corresponding to the expected luminance value is different from a resistor branch connected to a set pin, and the resistor branch connected to the set pin is the second resistor branch and a resistance value of the first resistor branch is greater than a resistance value of the second resistor branch, gradually decrease a duty cycle of a currently output PWM signal to a minimum duty $cycle_2$.

The minimum duty $cycle_2$ is a minimum duty cycle when the set pin is connected to the second resistor branch.

Step 706*b*: When a resistor branch connected to the set pin after switching is the first resistor branch, and the resistance value of the first resistor branch is greater than the resistance value of the second resistor branch, gradually decrease a duty cycle of a currently output PWM signal from a maximum duty $cycle_1$ to the duty cycle corresponding to the expected luminance value.

The maximum duty $cycle_1$ is a maximum duty cycle when the set pin is connected to the second resistor branch.

Likewise, for a fourth embodiment, step 703 may be replaced with step 703*c*, and step 706 may be replaced with step 706*c*, which as shown in FIG. 7C.

Step 703*c*: When the resistor branch corresponding to the expected luminance value is different from a resistor branch connected to a set pin, and the resistor branch connected to the set pin is the second resistor branch and a resistance value of the first resistor branch is less than a resistance value of the second resistor branch, gradually increase a duty cycle of a currently output PWM signal to a maximum duty $cycle_2$.

The maximum duty $cycle_2$ is a maximum duty cycle when the set pin is connected to the second resistor branch.

Step 706*c*: When a resistor branch connected to the set pin after switching is the first resistor branch, and the resistance value of the first resistor branch is less than the resistance value of the second resistor branch, gradually increase a minimum duty $cycle_1$ of a currently output PWM signal to the duty cycle corresponding to the expected luminance value.

The minimum duty $cycle_1$ is a minimum duty cycle when the set pin is connected to the second resistor branch.

A person of ordinary skill in the art may understand that all or some of the steps of the embodiments may be implemented by hardware or a program instructing related hardware. The program may be stored in a computer-readable storage medium. The storage medium may include: a read-only memory, a magnetic disk, or an optical disc.

The foregoing descriptions are merely example embodiments of the present invention, but are not intended to limit the present invention. Any modification, equivalent replacement, and improvement made without departing from the spirit and principle of the present invention shall fall within the protection scope of the present invention.

What is claimed is:

1. A backlight circuit, wherein the backlight circuit comprises a backlight power supply chip and an adjustable resistor circuit;

the backlight power supply chip comprises a set pin configured to set a reference current, an input pin, and an output pin;

the adjustable resistor circuit comprises a first end connected to the set pin and a second end connected to a ground, wherein the adjustable resistor circuit further comprises a first resistor branch and a second resistor branch, wherein the first resistor branch and the second resistor branch have different resistance values used to generate different reference currents, and wherein a resistance value R1 of the first resistor branch and a resistance value R2 of the second resistor branch meet one of the following conditions:

$$R1 \geq R2 \times \text{maximum duty cycle}_2/\text{minimum duty cycle}_1; \text{ and}$$

$$R1 \leq R2 \times \text{minimum duty cycle}_1/\text{maximum duty cycle}_2,$$

wherein the minimum duty $cycle_1$ is a minimum duty cycle when the set pin is connected to the first resistor branch, and wherein the maximum duty $cycle_2$ is a maximum duty cycle when the set pin is connected to the second resistor branch;

the adjustable resistor circuit further comprises a control end, wherein the control end is configured to receive a switching signal, and the adjustable resistor circuit selects, according to the switching signal, a resistor branch from the first resistor branch and the second resistor branch to connect to the set pin for generating the reference current; and the backlight power supply chip is configured to generate a drive current based on the reference current and a duty cycle of a pulse-width modulation (PWM) signal, wherein the PWM signal received by the input pin, and wherein the backlight power supply chip is further configured to output the drive current by using the output pin, wherein the drive current is used to drive a backlight source to emit.

2. The backlight circuit according to claim 1, wherein the adjustable resistor circuit further comprises a selector switch;

the selector switch comprises the control end and a selection end; and the selection end is configured to select, according to the switching signal received by the control end, a resistor branch from the first resistor branch and the second resistor branch to connect to the set pin.

3. The backlight circuit according to claim 2, wherein the adjustable resistor circuit comprises a first resistor and a second resistor that are connected in series; and the first resistor and the second resistor form the first resistor branch, and the second resistor forms the second resistor branch.

4. The backlight circuit according to claim 2, wherein the adjustable resistor circuit comprises a first resistor and a second resistor that are connected in series; and the first resistor and the second resistor form the second resistor branch, and the second resistor forms the first resistor branch.

5. The backlight circuit according to claim 2, wherein the adjustable resistor circuit comprises a third resistor and a fourth resistor that are connected in parallel;

the third resistor forms the first resistor branch; and the fourth resistor forms the second resistor branch.

6. The backlight circuit according to claim 1, wherein the switching signal is sent by a backlight controller when a resistor branch corresponding to an expected luminance value is different from the resistor branch connected to the set pin; and the expected luminance value is used to indicate expected backlight luminance emitted by the backlight source.

7. An electronic device, wherein the electronic device comprises a backlight controller, a memory, a backlight circuit, and a backlight source, the memory is connected to the backlight controller and stores an executable program of the backlight controller;

the backlight circuit comprises a backlight power supply chip and an adjustable resistor circuit;

the backlight power supply chip comprises a set pin configured to set a reference current, an input pin, and an output pin;

the adjustable resistor circuit comprises a first end connected to the set pin and a second end connected to a ground, the adjustable resistor circuit further comprises a first resistor branch and a second resistor branch, and the first resistor branch and the second resistor branch have different resistance values used to generate different reference currents;

the adjustable resistor circuit further comprises a control end, wherein the control end is configured to receive a switching signal, and the adjustable resistor circuit selects, according to the switching signal, a resistor branch from the first resistor branch and the second resistor branch to connect to the set pin for generating the reference current;

the backlight power supply chip is configured to generate a drive current based on the reference current and a duty cycle of a pulse-width modulation (PWM) signal, the PWM signal received by the input pin, and the backlight power supply chip is further configured to output the drive current by using the output pin;

the backlight controller is connected to the input pin of the backlight power supply chip in the backlight circuit, and is configured to send the PWM signal to the input pin of the backlight power supply chip; and the backlight controller is further connected to the control end of the adjustable resistor circuit in the backlight circuit, and is configured to send the switching signal to the control end of the adjustable resistor circuit; and the backlight source is connected to the output pin of the backlight power supply chip in the backlight circuit, and is configured to emit a backlight according to the drive current.

8. The electronic device according to claim 7, wherein the backlight controller is a central processing unit (CPU), a graphics processing unit (GPU), or a liquid crystal display (LCD) driver integrated circuit (IC).

9. The electronic device according to claim 7, wherein the backlight controller is further configured to:

obtain an expected luminance value, wherein the expected luminance value is used to indicate expected backlight luminance emitted by the backlight source;

determine a resistor branch corresponding to the expected luminance value, wherein the resistor branch is either the first resistor branch or the second resistor branch;

in response to determining that the resistor branch corresponding to the expected luminance value is different from the resistor branch connected to the set pin, send the switching signal to the control end of the adjustable resistor circuit; and send the PWM signal to the backlight power supply chip, wherein the duty cycle of the PWM signal is corresponding to the expected luminance value.

10. The electronic device according to claim 9, wherein: the backlight controller is further configured to: before sending the switching signal to the control end of the adjustable resistor circuit, in response to determining that the resistor branch connected to the set pin is the first resistor branch and that a resistance value of the first resistor branch is greater than a resistance value of the second resistor branch, gradually increase a duty cycle of a currently output PWM signal to a maximum duty $cycle_1$, wherein the maximum duty $cycle_1$ is a maximum duty cycle when the set pin is connected to the first resistor branch.

11. The electronic device according to claim 9, wherein: the backlight controller is further configured to: before sending the switching signal to the control end of the adjustable resistor circuit, in response to determining that the resistor branch connected to the set pin is the first resistor branch and that a resistance value of the first resistor branch is less than a resistance value of the second resistor branch, gradually decrease a duty cycle of a currently output PWM signal to a minimum duty $cycle_1$, wherein the minimum duty $cycle_1$ is a minimum duty cycle when the set pin is connected to the first resistor branch.

12. The electronic device according to claim 9, wherein: the backlight controller is further configured to: before sending the switching signal to the control end of the adjustable resistor circuit, in response to determining that the resistor branch connected to the set pin is the second resistor branch and that a resistance value of the first resistor branch is greater than a resistance value of the second resistor branch, gradually decrease a duty cycle of a currently output PWM signal to a minimum duty $cycle_2$, wherein the minimum duty $cycle_2$ is a minimum duty cycle when the set pin is connected to the second resistor branch.

13. The electronic device according to claim 9, wherein: the backlight controller is further configured to: before sending the switching signal to the control end of the adjustable resistor circuit, in response to determining that the resistor branch connected to the set pin is the second resistor branch and that a resistance value of the first resistor branch is less than a resistance value of the second resistor branch, gradually increase a duty cycle of a currently output PWM signal to a maximum duty $cycle_2$, wherein the maximum duty $cycle_2$ is a maximum duty cycle when the set pin is connected to the second resistor branch.

14. The electronic device according to claim 9, wherein: the backlight controller is further configured to: query a duty cycle corresponding to the expected luminance value; and in response to determining that a resistor branch connected to the set pin after switching is the second resistor branch and that a resistance value of the first resistor branch is greater than a resistance value of the second resistor branch, gradually increase a duty cycle of a currently output PWM signal from a minimum duty $cycle_2$ to the duty cycle, wherein the minimum duty $cycle_2$ is a minimum duty cycle when the set pin is connected to the second resistor branch.

15. The electronic device according to claim 9, wherein: the backlight controller is further configured to: query the duty cycle corresponding to the expected luminance value; and in response to determining that a resistor branch connected to the set pin after switching is the second resistor branch and that a resistance value of the first resistor branch is less than a resistance value of the second resistor branch, gradually decrease a duty cycle of a currently output PWM signal from a maximum duty $cycle_2$ to the duty cycle, wherein the maximum duty $cycle_2$ is a maximum duty cycle when the set pin is connected to the second resistor branch.

16. The electronic device according to claim 9, wherein: the backlight controller is further configured to: query the duty cycle corresponding to the expected luminance value; and in response to determining that a resistor branch connected to the set pin after switching is the first resistor branch and that a resistance value of the first resistor branch is greater than a resistance value of the second resistor branch, gradually decrease a duty cycle of a currently output PWM signal from a maximum duty $cycle_1$ to the duty cycle, wherein the maximum duty $cycle_1$ is a maximum duty cycle when the set pin is connected to the first resistor branch.

17. The electronic device according to claim 9, wherein: the backlight controller is further configured to: query the duty cycle corresponding to the expected luminance value; and in response to determining that a resistor branch connected to the set pin after switching is the first resistor branch and that a resistance value of the first resistor branch is less than a resistance value of the second resistor branch, gradually increase a duty cycle of a currently output PWM signal from a minimum duty $cycle_1$ to the duty cycle, wherein the minimum duty $cycle_1$ is a minimum duty cycle when the set pin is connected to the first resistor branch.

18. The electronic device according to claim 7, wherein a resistance value R1 of the first resistor branch and a resistance value R2 of the second resistor branch meet one of the following conditions:

$$R1 \geq R2 \times \text{maximum duty cycle}_2/\text{minimum duty cycle}_1, \text{ and}$$

$$R1 \leq R2 \times \text{minimum duty cycles/maximum duty cycle}_2, \text{ wherein}$$

the minimum duty $cycle_1$ is the minimum duty cycle when the set pin is connected to the first resistor branch; and the maximum duty $cycle_2$ is the maximum duty cycle when the set pin is connected to the second resistor branch.

19. A backlight adjustment method, applied to a backlight controller of an electronic device, wherein the electronic device comprises the backlight controller, a memory, a backlight power supply chip, an adjustable resistor circuit, and a backlight source;

the memory is connected to the backlight controller and stores an executable program of the backlight controller;

the backlight power supply chip comprises a set pin configured to set a reference current;

the adjustable resistor circuit comprises a first end connected to the set pin and a second end connected to a ground, the adjustable resistor circuit further comprises a first resistor branch and a second resistor branch, the first resistor branch and the second resistor branch have different resistance values used to generate different reference currents, and the adjustable resistor circuit further comprises a control end;

the backlight controller is connected to an input pin of the backlight power supply chip and the control end of the adjustable resistor circuit;

wherein the method comprises:

obtaining, by the backlight controller, an expected luminance value, wherein the expected luminance value is used to indicate expected backlight luminance emitted by the backlight source;

determining a resistor branch corresponding to the expected luminance value, wherein the resistor branch is either the first resistor branch or the second resistor branch;

in response to determining that the resistor branch corresponding to the expected luminance value is different from a resistor branch connected to the set pin, sending, by the backlight controller, a switching signal to the control end of the adjustable resistor circuit, wherein the adjustable resistor circuit selects, according to the switching signal, a resistor branch from the first resistor branch and the second resistor branch to connect to the set pin for generating the reference current; and sending, by the backlight controller, a PWM signal to the input pin of the backlight power supply chip, wherein a duty cycle of the PWM signal is corresponding to the expected luminance value, the backlight power supply chip is configured to generate a drive current based on the reference current and the duty cycle of the PWM signal, and send the drive current to the backlight source, and the backlight source is configured to emit a backlight according to the drive current.

* * * * *